US011313581B2

(12) United States Patent
Yaciuk

(10) Patent No.: US 11,313,581 B2
(45) **Date of Patent: *Apr. 26, 2022**

(54) LINEAR SUPPLY OUTLET (LSO) SYSTEM, APPARATUSES AND METHODS FOR BLENDING HEATING AND COOLING FENESTRATIONS WITH ARCHITECTURAL APPEARANCES

(71) Applicant: Robert Yaciuk, Richfield Springs, NY (US)

(72) Inventor: Robert Yaciuk, Richfield Springs, NY (US)

( * ) Notice: Subject to any disclaimer, the term of this patent is extended or adjusted under 35 U.S.C. 154(b) by 492 days.

This patent is subject to a terminal disclaimer.

(21) Appl. No.: 16/051,687

(22) Filed: Aug. 1, 2018

(65) Prior Publication Data

US 2018/0356120 A1 Dec. 13, 2018

(51) Int. Cl.
*F24F 13/08* (2006.01)
*F24F 13/072* (2006.01)

(52) U.S. Cl.
CPC ..... *F24F 13/084* (2013.01); *F24F 13/072* (2013.01)

(58) Field of Classification Search
CPC ..... F24F 13/084; F24F 13/072; F24F 13/082; F24F 13/0227; F24F 13/0254;
(Continued)

(56) References Cited

U.S. PATENT DOCUMENTS 2,564,334 A 8/1951 Kennedy
3,202,077 A 8/1965 Lee
(Continued)

FOREIGN PATENT DOCUMENTS

GB 2545891 * 7/2017 ..... F24F 13/06
WO 2011004025 A1 1/2011

OTHER PUBLICATIONS

International search report and written opinion for counterpart application PCT/US19/44217, issued by ISA/US dated Oct. 22, 2019.

(Continued)

*Primary Examiner* — Avinash A Savani
*Assistant Examiner* — Ryan L Faulkner
(74) *Attorney, Agent, or Firm* — Jay R. Yablon

(57) ABSTRACT

A linear supply outlet system and related devices and methods for efficiently passing air into an indoor space while integrating heating and cooling fenestrations with architectural appearances, comprising: an active register comprising: an active fenestration projection comprising a width thereof no smaller than ⅜" and no larger than ⅞", culminating in an airflow opening at a forward extremity of the active register; an active register mounting flange recessed rearward of the airflow opening; and at least one duct connection fabricated to connect with an SDHV duct; and a passive register-connector comprising: a passive fenestration projection comprising a width thereof which is equal to the width of the active fenestration projection, culminating in a dummy opening at a forward extremity of the passive register-connector; a passive register-connector mounting flange recessed rearward of the dummy opening; and omitting any duct connection for connecting with an airflow duct.

24 Claims, 10 Drawing Sheets

(58) Field of Classification Search
CPC ..... F24F 13/0209; F24F 13/075; F24F 1/52; F24F 2007/003; F24F 7/10; F24F 13/068; F24F 2221/17; F24F 13/06; F24F 1/0053; F24F 1/64; F24F 1/0047; F24F 5/0092; F24F 2221/14; F24F 7/00; E04F 17/04
USPC ..... 454/363, 362, 14, 243, 354, 270, 284
See application file for complete search history.

(56) References Cited

U.S. PATENT DOCUMENTS

| | | | | |
|---|---|---|---|---|
| 3,440,947 | A | 4/1969 | Averill | |
| 3,918,354 | A | 11/1975 | Lambert | |
| 4,869,157 | A | 9/1989 | Hungerford | |
| 6,168,518 | B1 * | 1/2001 | Messmer ..... | F24F 13/06 454/284 |
| 6,192,640 | B1 * | 2/2001 | Snyder ..... | F24F 13/084 220/3.5 |
| 6,386,970 | B1 | 5/2002 | Vernier et al. | |
| 2016/0273797 | A1 * | 9/2016 | Bruhnke ..... | F24F 13/082 |

OTHER PUBLICATIONS

Delivered Efficiency of the Unico Small-Duct High-Velocity Heating and Cooling System, Unico, Inc., Apr. 1, 2010.
New Efficiency Standards for Unitary Air-Conditioning Equipment, Letter from Oak Ridge National Laboratories, May 25, 2005.
Air Diffusers supply and exhaust ventilation systems. (Sep. 2005). Retrieved Feb. 3, 2021, from https://cms.esi.info/ Media/documents/ Brook_continuousslot_ML.pdf, hereinafter "Brooke" (Year: 2005).
Advance Air (Linear Slot Diffuser 5000 series. (Dec. 2017). Retrieved Feb. 3, 2021, from https://www.advancedair.co.uk /products/diffusers/ linear-slot-diffuser-5000-series, hereinafter "Advanced") (Year: 2017).
Advance Air catalog for the 5000 series linear diffuser (Year: 2017).

* cited by examiner

LINEAR SUPPLY OUTLET (LSO) SYSTEM, APPARATUSES AND METHODS FOR BLENDING HEATING AND COOLING FENESTRATIONS WITH ARCHITECTURAL APPEARANCES

BACKGROUND OF THE INVENTION

Heating and cooling the homes and buildings we live and work in is critical to comfort and productivity. A very high percentage of heating and cooling systems provide conditioned air through a system of ductwork that delivers this air to the interior/indoor environment of the home or building. The heating and cooling equipment and duct systems themselves are hidden behind wall, ceiling and floor surfaces. The only evidence of these heating and cooling systems within a building's interior indoor space is the supply outlets/registers or grills that join the hidden ductwork through the finished interior building surfaces where these systems are installed. These visible components are utilitarian, awkward to conceal without affecting heating and cooling performance, and difficult to blend into a sophisticated interior building design. They are unattractive and boldly announce the utility of their purpose. It is these supply outlets/registers, or fenestrative components which are the subject of this disclosure.

Small Duct High Velocity (SDHV) heating and cooling systems comprise a very small segment—less than 5%—of the ducted forced air heating and cooling equipment market. A unique feature of SDHV equipment design is that the equipment and duct systems are approximately half the size of other types of forced air heating and cooling systems. This allows them to be more easily concealed in interior building designs and provide more living, or usable space per building volume. This is because the small physical dimensions of SDHV systems enable elimination of large soffits, chases, and living space otherwise lost to hiding the physically-larger components of conventionally-ducted heating and cooling systems. On technical merit, SDHV has been proven by federal and independent studies, which are publicly available, to be more efficient, more comfortable and healthier than conventional large duct forced air systems.

For example, as included in an information disclosure filed with this application, in 2005, Oak Ridge National Laboratory advised the U.S. Department of Energy that SDHV Systems were more efficient, more comfortable, provided more-even temperatures throughout the environment with no stratification, and dehumidified far better than conventionally-ducted systems. SDHV Systems were found healthier because they circulated twice as much air through the filtering systems installed. Because the ratings standards at that time tended to mask these benefits, ORNL recommended that the DOE work to improve the ratings standards by separating SDHV from Conventional. Since SDHV comprises a small percentage of overall forced air systems this effort has not been a priority for the DOE.

It is generally understood in the art that the best heating type is radiant, but also the costliest especially when installed under wood floors, and that the best-quality air conditioning is SDHV due the comfort and dehumidification benefits. SDHV is the second-best heating behind radiant due to its evenness and the fact that it does not disturb the volume of air as much as conventionally ducted systems during heating cycles, and does not feel as dry without humidification.

SDHV heating and cooling systems provide the greatest value-added for both residential and light commercial projects in which interior design and appearance is a primary focus. As such, these systems are most-often employed at the high end of the realty markets, where fine architecture and design is demanded. However, at present, commonly-available fenestrative supply outlets/registers available from original equipment and third-party manufacturers do not provide the architectural and interior design communities any offerings that are acceptable. The typical response by the architectural and design communities to commonly-available round floor and ceiling supply outlets is that these offerings are utilitarian, surface mounted and not suitable for a good interior design. They also hamper decorative wall finishes due their surface mounting and round shape which is not easily compatible with wall paper, tile and wood surface finishes. The architectural and design communities commonly refer to these round components mounted on the surface as "nautical" or "unfinished," or as "habit-trails" (suggesting the pet hamster playground). The other commonly-available original and third-party fenestrative equipment offering is a "slotted outlet." This suffers the same faults. It is surface mounted and is generally referred to as a "mail slot." It is regarded as an eyesore to any good interior designer. The architectural and design community in general finds all supply outlets/register fenestrative components available in the prior art at present to be unacceptable.

It would be desirable to overcome the aforementioned difficulties by providing a novel and inventive system of fenestrative components which take advantage of the small duct sizes of Small Duct High Velocity heating and cooling systems to offer a clean, continuous, symmetrical, or asymmetrically placed, visually-attractive design element that disguises where these components join the interior building surfaces, without compromising utilitarian function. Such a novel and inventive system of fenestrative components which integrate heating and cooling fenestrations with architectural appearances in a visually-superior fashion shall be referred to as a Linear Supply Outlet (LSO) system.

SUMMARY OF THE INVENTION

Disclosed herein is a linear supply outlet system and related devices and methods for efficiently passing air motivated by a small duct high velocity (SDHV) heating and cooling system into an indoor space while integrating heating and cooling fenestrations with architectural appearances, comprising: at least one an active register, each active register comprising: an active fenestration projection comprising a width thereof no smaller than ⅜" and no larger than ⅞", and a length thereof no smaller than 12", culminating in an airflow opening at a forward extremity of the active register; an active register mounting flange recessed rearward of the airflow opening by an active register recess distance approximately equal to a thickness of an indoor space boundary material into which the active register is to be installed; and at least one duct connection fabricated to connect with an SDHV duct, and configured to pass air from the SDHV heating and cooling system through the airflow opening into the indoor space; and at least one passive register-connector, each passive register-connector comprising: a passive fenestration projection comprising a width thereof which is equal to the width of the active fenestration projection, culminating in a dummy opening at a forward extremity of the passive register-connector; a passive register-connector mounting flange recessed rearward of the dummy opening by a passive register-connector recess distance equal to the active register recess distance; and omitting any duct connection for connecting with an airflow duct.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

DETAILED DESCRIPTION

The Linear Supply Outlet (LSO) system, devices and methods to be disclosed herein, provide interior building architectural and design professionals with a system of fenestrative "active" air supply outlet registers and matching decorative "passive" register-connectors which can be used individually or in combination as a system of active and passive components, to create a simple cohesive design element which disguises their utilitarian purpose and which can be blended into any good interior design. The components of this LSO system mount flush to any interior surface (wall, ceiling or floor), in any direction, regardless of the framing supporting that surface. This creates a continuous, unbroken visual line which becomes a design element of any length and any orientation for use by the creator of the interior design. These unique active registers and passive register-connectors are provided for use individually or as a system of components which disguise their utilitarian purpose to blend into the room interior, facilitating superior architectural design. Heretofore, there has never been a system of SDHV supply outlets/registers offering these features and benefits to the building architectural and design communities, and the consumers who live and work in the buildings which utilize these.

Before reviewing details of the various component devices used to implement the system of this invention and the associated method of installation and use, it is helpful to illustrate how this system visually appears to observers in an indoor living or working space after it has been fully installed. By first fully understanding the utilitarian and design objectives of the invention, it is easier to subsequently understand the components of the system used to implement these objectives.

Figure 1:
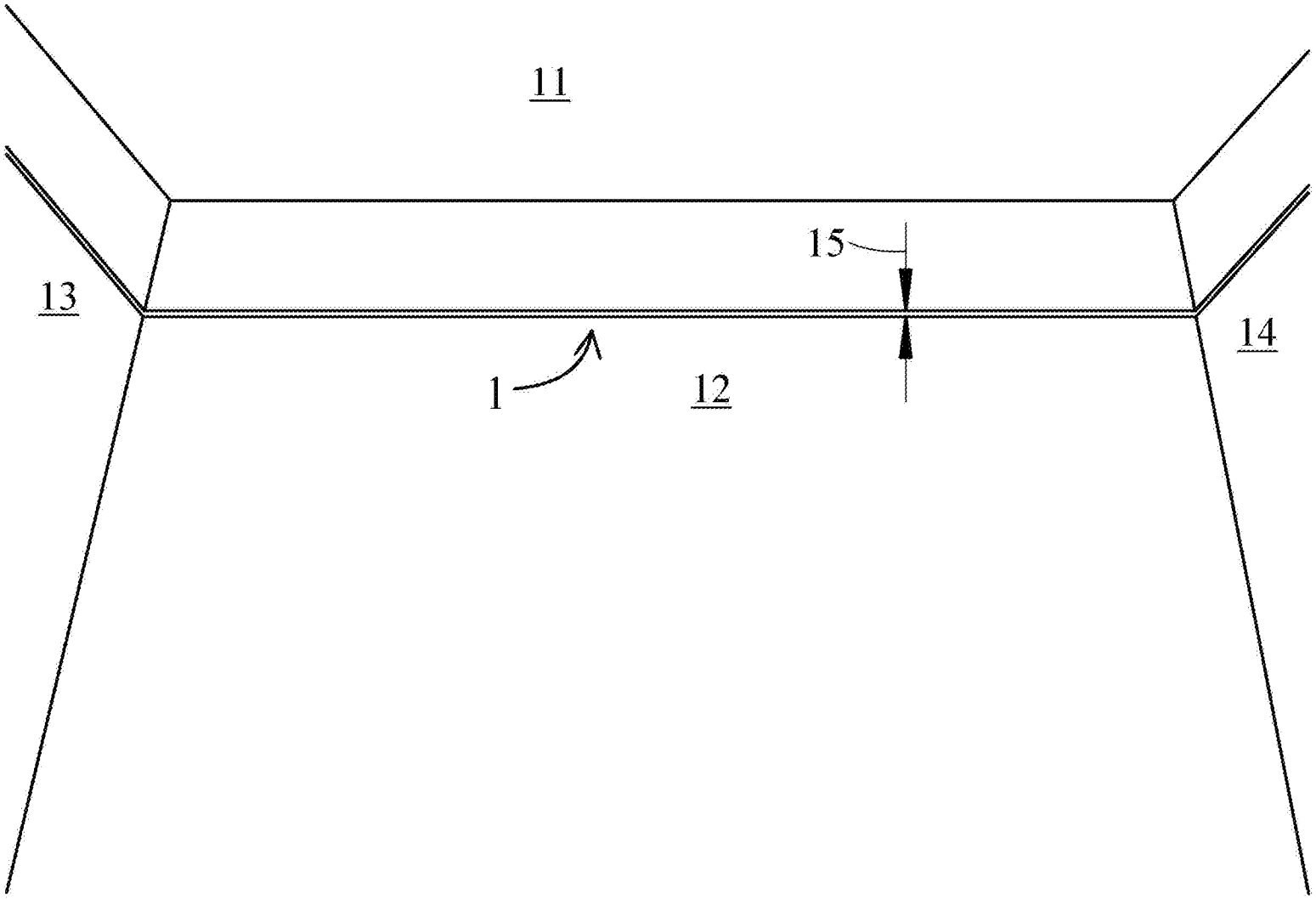
FIG. 1 illustrates from the perspective view of someone standing on the floor in the middle of an indoor room, a portion of this room in which the system linear supply outlet system of the invention has been continuously installed along the walls of this room, below a ceiling of this room, in a so-called "high-wall installation." Viewed upside down, this figure may also be used to illustrate a "low-wall installation."
Figure 2:
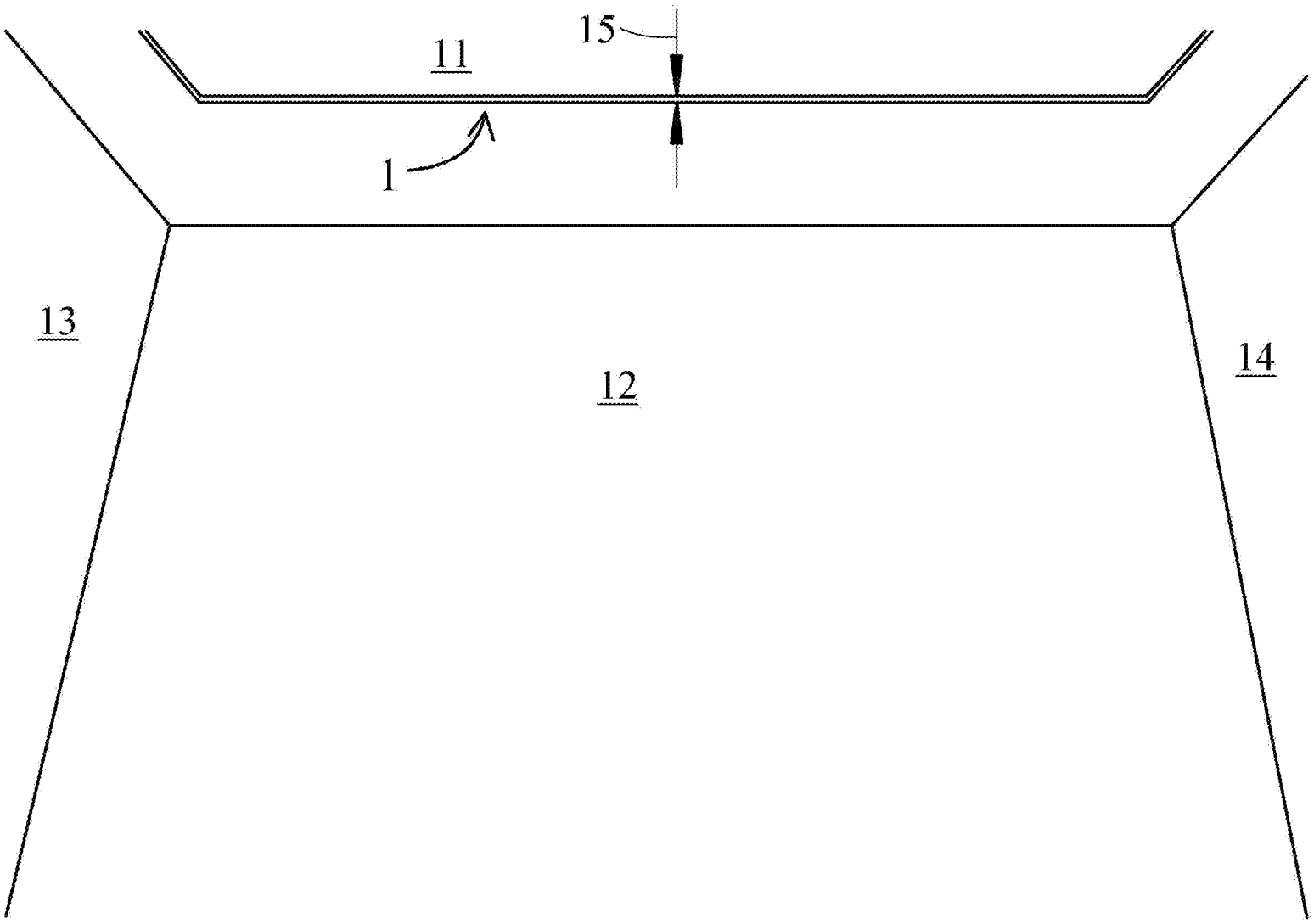
FIG. 2 illustrates from a similar perspective view of someone standing on the floor in the middle of the room, a portion of this room in which the system linear supply outlet system of the invention has been installed along the outer perimeter of the ceiling, interior to the walls of the room, in a "ceiling-perimeter installation." Viewed upside down, this figure may also be used to illustrate a "floor-perimeter installation."

As an example, and without limitation, FIG. 1 illustrates from the perspective view of someone standing on the floor in the middle of the indoor space of a room, a portion of this room in which the system linear supply outlet 1 system of the invention has been continuously installed along the upper part of a room back wall 12 and left-side wall 13 and right-side wall 14, about a foot or so below a ceiling 11 of this room. We shall refer to this as a high-wall installation, because it is along the walls near the ceiling. As another example, and also without limitation, FIG. 2 illustrates from a similar perspective view of a similar room, a portion of the room in which the system linear supply outlet system of the invention has been installed along the outer perimeter of the ceiling 11, about of foot or so interior to the back wall 12, left-side wall 13 and right-side wall 14. We shall refer to this as a ceiling-perimeter installation, because it is along the ceiling near the walls. The above use of relative terms such as "left" and "right" and "back" in reference to "walls" is employed merely to speak about the drawings in a comprehensible manner and is not in any way limiting as to the claimed invention.

Another possible installation within the scope of this disclosure and its associated claims, is a low-wall installation near the floor of the room, which is illustrated simply by viewing FIG. 1 upside down and substituting floor for ceiling and interchanging left and right. And another possible installation, is a floor-perimeter installation along the floor near the walls, which is illustrated simply by viewing FIG. 2 upside down and again substituting floor for ceiling and swapping left and right.

In all cases, the linear supply outlets 1 of this system comprise fenestrations (openings) which have preferred widths 15 of substantially five-eighths of an inch (⅝") and are manufactured accordingly. The outlet 1 serves the utilitarian function of delivering conditioned air (which may be cooled or heated) therethrough, motivated by a Small Duct High Velocity (SDHV) heating and cooling system, as will shortly be detailed. In general, SDHV systems which motivate the air passed by applicant's invention is schematically illustrated by 37, the SDHV ducts which transmit this air from the SDHV system 37 to the duct connections 32 of the invention are schematically illustrated by 38, adjoining 37, so as to represent the transmission of air from the air-motivating SDHV system 37 through SDHV ductwork 38 in the manner known in the art for such systems. Unnumbered arrows are also included to schematically illustrate the transmission of air from 37 via 38 to the duct connections 32 of the various registers of applicant's invention disclosed herein. Although ⅝" is the preferred width 15, this is exemplary and not limiting in relation to this disclosure and its associated claims. Rather, this width may be as small as ⅜" and as large as ⅞", or even 1" or 1.5", with the important caveat that in experimental prototype testing—balancing design considerations against optimizing the flow of conditioned air from a typical SDHV system 37—it has been shown that ⅝" is an optimum width. At various places in this disclosure, we shall refer to the element referenced in the drawings by the numeral 1, as a line, fenestration, opening or outlet depending on context. This is because while a line is the desired visual appearance, this line is achieved by openings or fenestrations of the various components of the invention, and the openings or fenestrations are provided by the airflow outlets of the active components and by design features of the passive components.

It will be appreciated from FIGS. 1 and 2 that the thin, continuous, uniform outlet line 1 (having a preferred ⅝" width) has a simple, clean and elegant design appearance, whereby even as the outlet 1 serves to deliver conditioned air, this utilitarian function is masked by this simple, thin line which facilitates blending into the architectural design. The components of this system are manufactured in a modular fashion which affords great flexibility for the way that the design layout of the installation is configured, which is to say, the illustrations in FIGS. 1 and 2 are illustrative, but not at all limiting. Rather, they are open to unlimited design variations chosen at will by the designer(s) of the interior space.

For example, not limitation, although FIG. 1 shows the linear supply outlet 1 running continuously across the entire back wall 12 and joining continuously with the outlet 1 on the side walls 13 and 14, a design choice may also be made in which this line is broken. And this may be chosen to be broken where the walls meet, or along a given wall, or both, at will. Similarly, the ceiling installation of FIG. 2 may be broken or not based on design choice. Likewise, although the line of the outlet 1 in FIGS. 1 and 2 is shown to run parallel to corner lines between and among ceilings, walls and floors, this too is a design choice and it is possible to choose a design in which these lines are not parallel but angled in some manner. And although not optimum for airflow, one might even choose, for example, a vertical layout for the outlet 1 line running part or all of the way, broken or unbroken, from ceiling to floor.

Likewise, although it has been stated that the high-wall installation is about a foot below the ceiling and the ceiling-perimeter installation is about a foot interior to the walls (same with low-wall and floor-perimeter), this too is non-limiting. It is desirable to ensure optimized airflow into the room that the outlet 1 be no less than about six inches (6") from the walls for ceiling or floor installations, and likewise no less than about six inches (6") from the ceiling or floor for wall installations. Further, so that the air enters near the sides of a room and not in the center where it would directly blow on the room occupants which is not desired, and because it is desired to hide the utilitarian parts of outlet 1 from view and so these will have their the best visual appearances when a user looks at them from at least a couple of feet away and from an angle, it is also desirable that the outlet 1 be no more than about eighteen inches (18") from the walls for ceiling or floor installations, and likewise no more than about eighteen inches (18") from the ceiling or floor or wall installations. And in general, it is preferred to have a range of from about 6" to 18" for the distance between the outlet 1 and the room "corner" element that it is near. But again, although installations outside these preferred ranges are not best practice, such installations are still regarded to be within the scope of this disclosure and its associated claims.

It will also be appreciated that the preferred ⅝" line of the utilitarian outlet 1 can be used as a design feature in connection with other commonly-used room-design elements such as wallpapers, wallpaper borders, ceiling or floor moldings, soffits, or the like, and that that exact placement of the outlet 1 line may be determined by the dimension of these commonly-used room-design elements. It will also be appreciated that wall and/or ceiling paints may be used in some chosen design fashion in combination with the lines of outlet 1.

In sum, the various component devices of this invention, now to be detailed, are used and installed in combination with one another to create a thin fenestration line 1 with a preferred (manufactured) width of about ⅝", which line 1 can be placed in whatever visual design configuration is desired and integrated in any chosen fashion with the accompanying design elements of the room, all within the scope of this disclosure and its associated claims. The only utilitarian constraint, is to optimize air flow and circulation in relation to the chosen visual appearance. With the foregoing objectives and the balancing of utilitarian and design considerations having been disclosed, we now turn to the specific invention components employed to create the fenestration line 1 illustrated in non-limiting fashion by FIGS. 1 and 2.

The overall linear supply outlet system makes uses of three main types of active supply outlets/registers. These are: straight registers which will be reviewed in FIGS. 3 and 4, right-angle registers which will be reviewed in FIGS. 5 and 6, and ceiling registers which will be reviewed in FIGS. 7 and 8. These registers connect the hidden supply ducts (schematically illustrated by 38) of an SDHV system 37 to the visble, finished interior surfaces of the building, that is, to walls, ceilings and floors. As discussed in connection with FIGS. 1 and 2, the only thing visible as a result of employing these registers, is an elongated outlet fenestration 1 with a preferred width 15 of substantially five-eighths of an inch (⅝"). For example, not limitation, it is preferred that each of these three register types be fabricated and provided in two models differing only in length and in the number and placement of internal air feed connections. The shorter is a single-duct connection model, made to fit in a single framing bay width or parallel to standard framing. The longer is a multiple-duct connection model, made to fit in a modified double framing bay width or parallel to standard framing. During installation, these active components and combinations thereof are placed and built into in any surface—wall, ceiling or floor—in any direction, regardless of the direction of the supporting framing, to fulfill the conditioned air delivery requirements of a room.

Figures 9, 10:
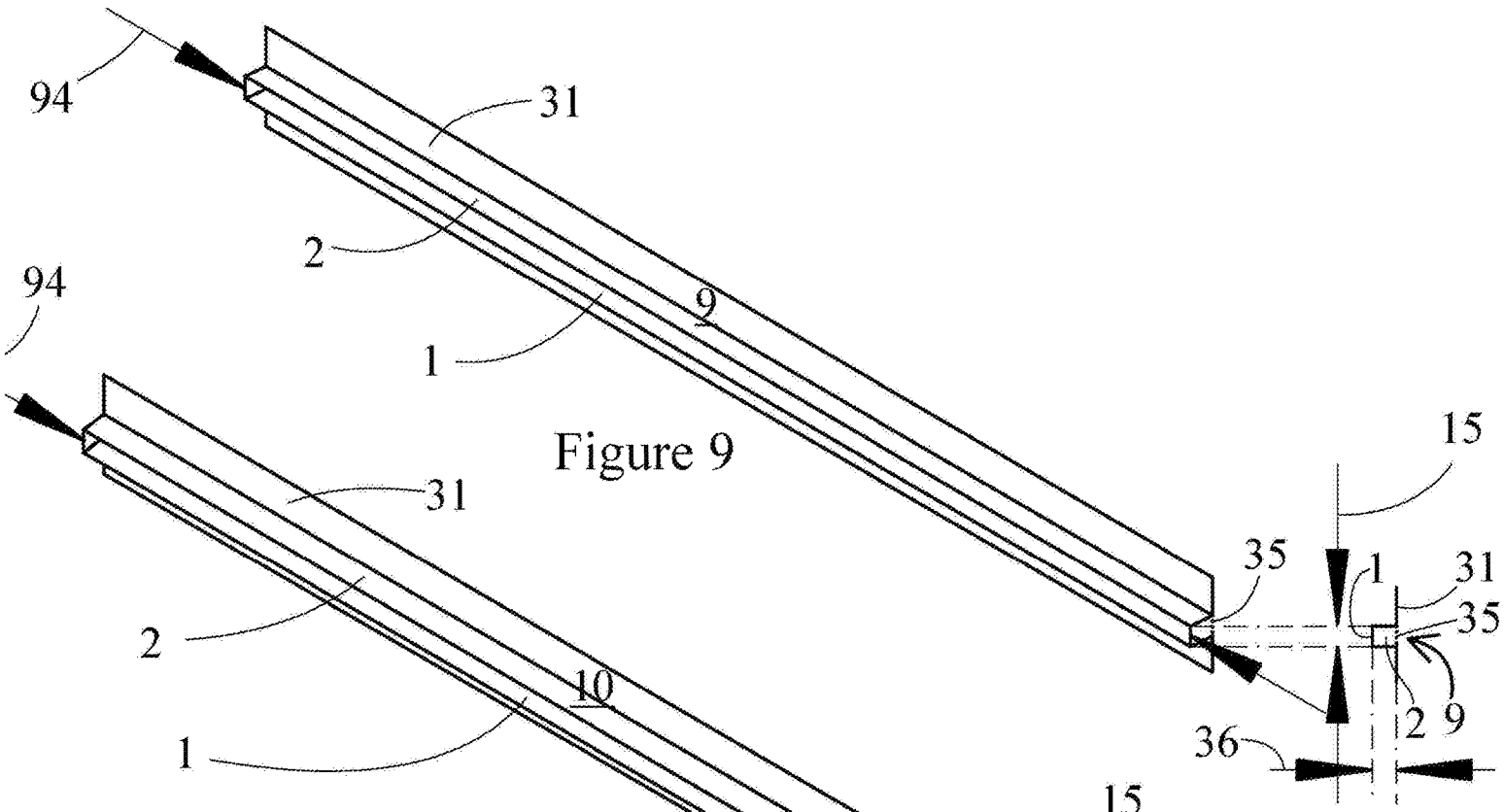
FIG. 9 illustrates a front-right-top perspective view, projected with a side plan view, of an orthogonally-angled passive register-connector used in accordance with the invention as a component that does not flow air but rather provides a consistent visual line astride and between the active registers of FIGS. 3 through 8.
FIG. 10 illustrates a front-right-top perspective view, projected with a side plan view, of a non-orthogonally-angled passive register-connector used as one of the passive components in accordance with the invention, which does not flow air but rather provides a consistent visual line astride and between the active registers of FIGS. 3 through 8.

Additionally, as will be reviewed in FIGS. 9 and 10, the linear supply outlet system employs one type of passive register-connector in both straight and angled variants, which may also be referred to as the detailing fenestration. For example, not limitation, this is preferably fabricated into a standard length of 36" and can be field-cut to shorter lengths and/or used in multiples. These passive register-connectors are affixed to the supporting framing or blocking to continue the visual appearance of the active fenestrations, as required to create a visually-pleasing design appearance line. These passive or decorative components, as well as the active components, may also be optionally used to house LED Strip lighting for additional accent or dramatic effect. Now we turn to examine these specific components.

Figure 3:
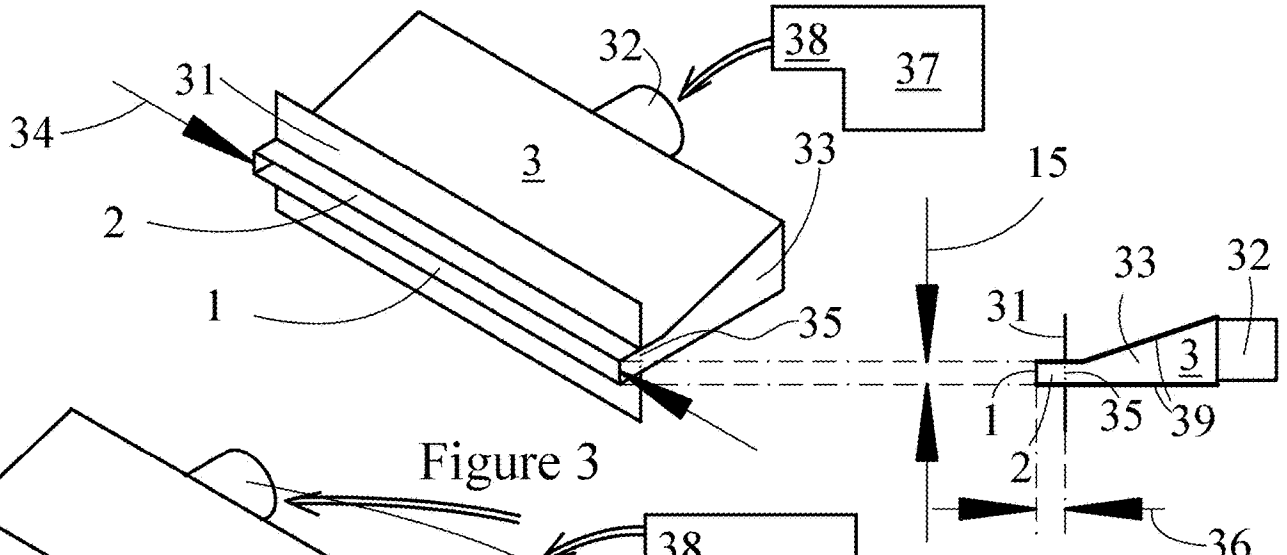
FIG. 3 illustrates a front-right-top perspective view, projected with a side plan view, of a single-duct straight-flow register used as one of the active airflow components in accordance with the invention.

FIG. 3 illustrates a single-duct straight-flow active register 3 that does not change the path of the conditioned air flowing from the ductwork to the interior environment. The right-hand portion of FIG. 3 shows a side view 33, and the left-hand portion of FIG. 3 shows a top-right perspective view of this register 3. This figure (and others to follow) includes projection lines cross-referencing the airflow opening 1 as between these two views. As discussed in relation to FIGS. 1 and 2, this airflow opening 1 preferably comprises a width 15 of ⅝". If one should choose to fabricate this width 15 to be other than ⅝"—which is still regarded to be within the scope of this disclosure and its associated claims—it is important that all other components to momentarily be reviewed also be matched for consistency with whatever width 15 is selected. This register 3 also preferably comprises a length designated by 34 of approximately 13.5", although again, manufacturing other lengths is fully within the scope of this disclosure and its associated claims. The 13.5" length comports well with the dimensions of standard framing practices in the construction arts, and although permitted, it would not be best practice to have this length 34 be anything smaller than 12".

This single-duct straight-flow register 3 may be installed perpendicularly to standard framing within a standard 16" on-center framing bay or parallel to existing framing members, at the designer's election. This register 3 (and others to follow) contains an active register mounting flange 31 for ease of fastener penetration that allows mounting of this register 3 solidly to either the face of supportive framing or the rear of the sheet rock interior surface. This active register mounting flange 31 is preferably perforated as will be discussed in relation to FIG. 15.

The register 3 (and others to follow) further contains a fenestration projection 2 projecting forward of the active register mounting flange 31, culminating in the airflow opening 1 illustrated as the forward extremity of the register 3. This opening 1 simultaneously becomes part of the overall visual line 1 of FIGS. 1 and 2 after installation. As a result, the active register mounting flange 31 is recessed rearward of the airflow opening 1 by an active register recess distance 36 approximately equal to a thickness of an "indoor space boundary material," i.e., ceiling-board, wallboard and/or floorboard, with which the active register 3 is to be used. That is, this projection 2 is fabricated to match the depth of the sheetrock or flooring or equivalent material that is used for the wall, floor and ceilings of the indoor space, which in the art is typically ¾", but which may vary in any specific circumstance.

As we shall see, all other registers and the passive register-connectors also contain a similar flange 31 and fenestration projection 2. The interior or visible edge of the register 3 is meant to be used to as guide to the interior finish tooling, such as a wall compound blade, so as to leave only the airflow opening 1 visible when the wall ceiling or floor is finished. The wall, ceiling or floor finish can end coincidental with (flush with) the outer edge of these components in the event the recess distance 36 equal is equal to the material thickness, or by design choice can be made to project slightly from the surface if the recess distance 36 is slightly larger than (more generally, approximately equal to) the material thickness.

A single-duct connection 32 which preferably comprises, without limitation, a round or oval cross-section, points toward the rear of register 3 and so becomes hidden when the register is mounted within the framing. This duct connection 32 is fabricated to connect with a standard 2" diameter SDHV duct 38, which duct is preferably sound-attenuating. There are also SDHV systems 37 with 2.5" diameter ducts 38; consequently, it is understood that the duct connection 32 may also be designed within the scope of this disclosure and its associated claims to mount with these larger-diameter ducts 38, as well as with or any other diameter or shape or type of ducts 38 that may be used in the art now or in the future. This single-duct straight-flow register 3 including the wedge-shaped cross section 33 narrowing from back to front is aerodynamically configured to allow excellent air flow with low air noise levels compared to commonly-available prior art supply outlets/registers and fenestrative components. Although not illustrated, this register 3 may be insulated with closed cell foam or equivalent to aid in noise reduction and minimize heat loss and the potential for condensation during cooling seasons. This closed cell foam or equivalent, is illustrated by 39, with thicker lines in FIGS. 3 through 8 shown in the regions over which it is beneficial to install this foam or equivalent 39.

Finally, each end of the opening 1 the single-duct straight-flow register 3 comprises optional scoring 35 which enables one or both of the ends of the opening 1 to be broken off if desired. At the solid lines in the illustration of FIG. 3 which are perpendicular to the left of the score line 35 (angled in the drawing because of the perspective view) the components are disconnected in the event there is said scoring 35, so that the end may be broken off simply by rotating back and forth about the scoring 35 until the scoring 35 breaks. This is utilized in the common circumstance where the single-duct straight-flow register 3 is not at the end of a design line 1, but rather has an adjacent component which continues the design line in the manner of FIGS. 1 and 2. In this way, even though two different pieces are linearly adjacent after installation, the line 1 between the two pieces looks visually continuous not broken. In the circumstance where a single-duct straight-flow register 3 is the last register in a line, the end need not be broken off with the scoring 35.

Figure 4:
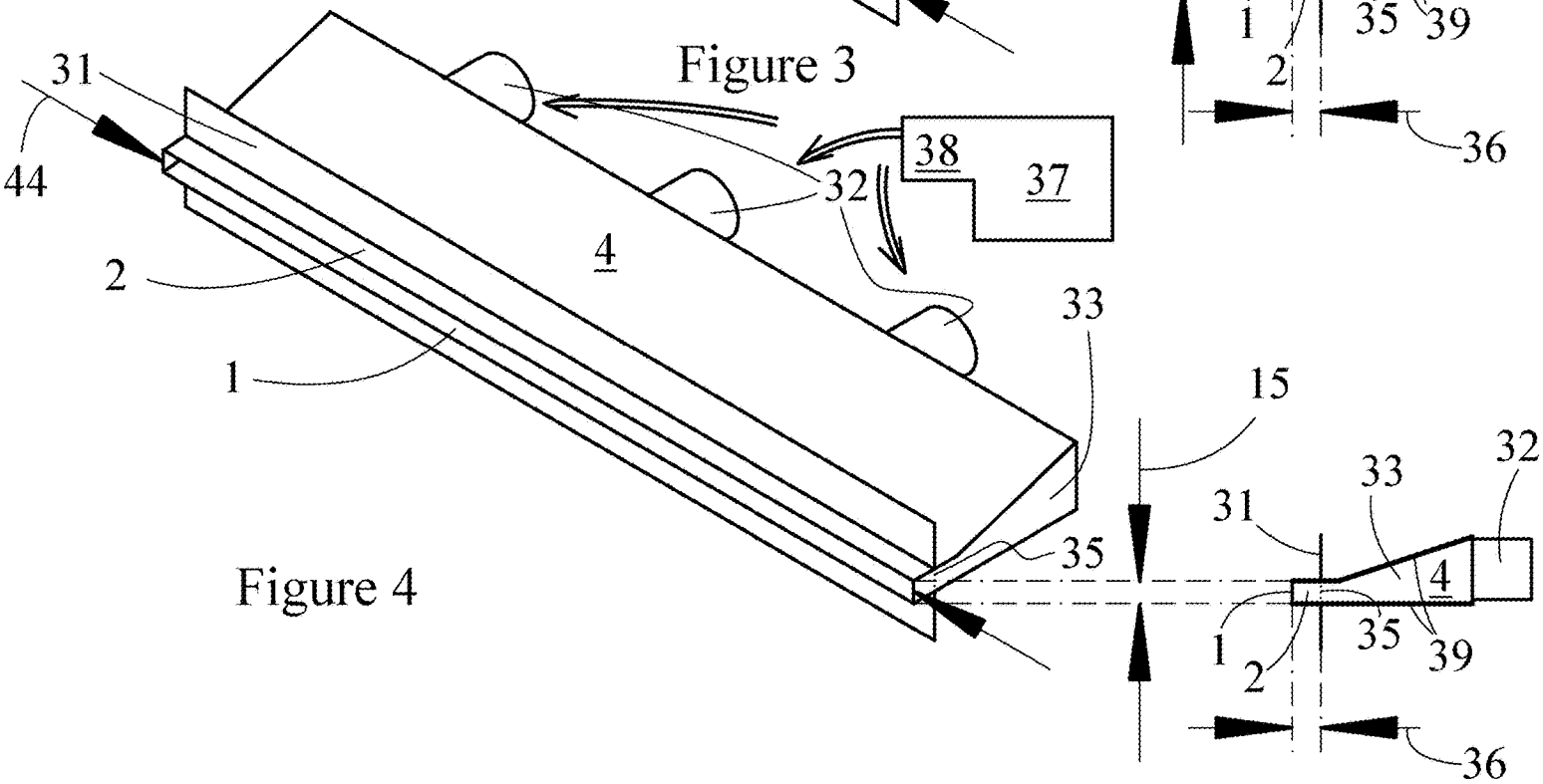
FIG. 4 illustrates a front-right-top perspective view, projected with a side plan view, of a multiple-duct straight-flow register used as one of the active airflow components in accordance with the invention.

FIG. 4 illustrates a multiple-duct straight-flow register 4 that likewise does not change the path of the conditioned air flowing from the duct to interior environment. This comprises a three-duct connection 32 and it is designed to fit in a double standard construction framing bay modified to allow installation. This is generally easy to do and does not affect most structural framing considerations, which are similar to those for a door or window width in a vertical wall. Horizontal surfaces may require some additional consideration. The side view 33 of multiple-duct straight-flow register 4 is identical in all respects to that of single-duct straight-flow register 3, and in fact register 4 differs from register 3 in only two respects: First, its length designated by 44 is longer, and is preferably 28". Second, for illustration not limitation, it contains three duct connections 32 rather than a single-duct connection. Other than these two differences, the straight flow registers 3 and 4 are identical. Especially, their airflow openings 1 each have the exact same width 15, preferably ⅝." This is so that once installed, a consistent line can be established regardless of which register type is employed.

Figure 15:
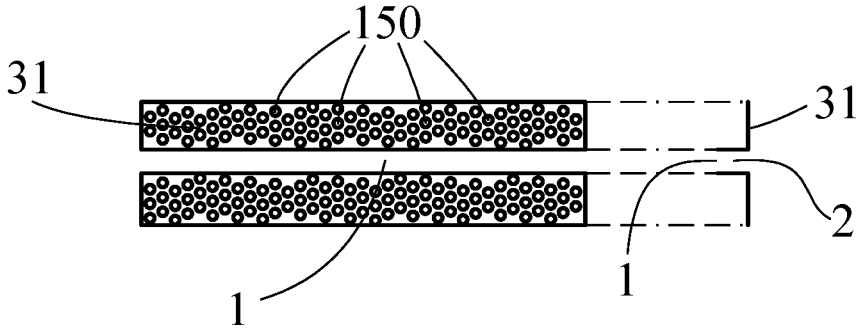
FIG. 15 illustrates a frontal plan view, projected with a side plan view, of an exemplary, non-limiting manner in which the mounting flange of all the system components of FIGS. 3, 4, 5, 6 and 9 is preferably perforated to aid in its permanent attachment behind a wall, ceiling or floor of the indoor space.
Figure 16:
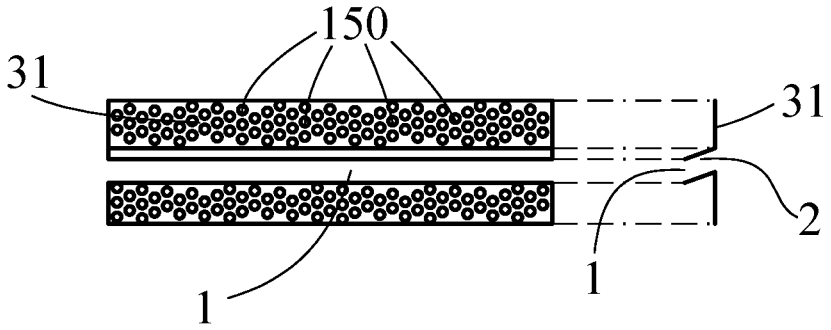
FIG. 16 similarly illustrates a frontal plan view, projected with a side plan view, of an exemplary, non-limiting manner in which the mounting flange of all the system components of FIGS. 7, 8 and 10 is preferably perforated to aid in its permanent attachment behind a wall, ceiling or floor of the indoor space.

Specifically, multiple-duct straight-flow register 4 also contains an active register mounting flange 31, preferably-perforated as illustrated in FIG. 15, that allows mounting of this component solidly to either the face of supportive framing or the rear of the sheet rock interior surface. And it contains a similar fenestration projection 2 culminating in the opening 1 with the same active register recess distance 36 approximately equal to the thickness of the indoor space boundary material with which the active register 4 is to be used. The interior or visible edge of the component may likewise be used to as guide to the interior finish tooling that will leave only the opening 1 visible when the wall, ceiling or floor is finished, either flush or slightly protruding, as desired by the interior designer.

The duct connections 32 likewise connect with a standard 2" or 2.5" SDHV (preferably sound-attenuating) duct 38, or any other ducts 38 that may be used in the art now or in the future. Again, as with FIG. 3, the aerodynamics of the funneled side cross section 33 allow excellent air flow with little air noise levels compared to common currently-available supply outlets/registers and fenestrative components. These registers 4 may likewise be optionally insulated with closed cell foam or equivalent 39 to aid in noise reduction, and minimize heat loss and the potential for condensation during cooling seasons. And, these registers 4 have the same scoring 35 for the same purpose as in FIG. 3.

This multiple-duct straight-flow register 4 can be produced in other multiple-duct connection variations within the scope of this disclosure and its associated claims. For example, while the three duct connections 32 are illustrated to be equally-spaced and symmetric about the center of the length 44, other spacings including asymmetrical unequal spacings may be considered. Also, in combination with varying spacing arrangements, one might utilize a different number of duct connections 32, for example not limitation, two or four or five.

Figure 5:
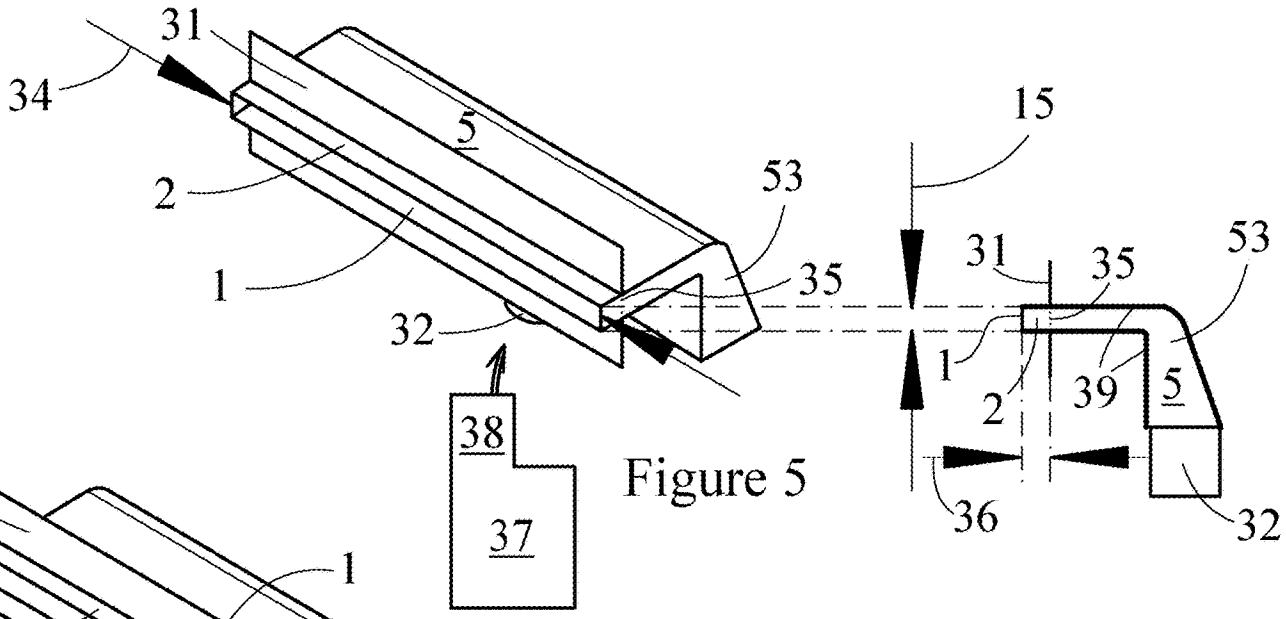
FIG. 5 illustrates a front-right-top perspective view, projected with a side plan view, of a single-duct orthogonal-flow register used as one of the active airflow components in accordance with the invention.

FIG. 5 illustrates a single-duct orthogonal-flow register 5 which changes, or turns, the path of the conditioned air flowing from the duct 32 to interior environment orthogonally by 90 degrees from its entry direction into the register 5. This register 5 is configured and expected to be installed most often in a vertical wall application for horizontal air flow emanating from a vertical duct (i.e. where the duct runs up or down behind and parallel to the wall but air needs to be pushed out away from the plane of the wall). But it may be used in any circumstance that requires redirecting the air flow 90 degrees. As with the single-duct straight-flow register 3, this register 5 is configured to be installed perpendicularly to standard framing within a standard 16" on center framing bay or parallel to existing framing members at the designer's election. It likewise contains the same active register mounting flange 31 that allows mounting of this register 5 solidly to either the face of supportive framing or the rear of the sheet rock interior surface, set back with the same active register recess distance 36 determined as reviewed in FIGS. 3 and 4. And it contains a similar fenestration projection 2 culminating in the opening 1.

The interior or visible edge of the component is again meant to be used to as guide to the interior finish tooling so as to leave only the opening 1 visible when the wall, ceiling or floor is finished. The duct connection 32 in the lower rear hidden within the framing is also designed to connect standard 2" or 2.5" SDHV (sound-attenuating) ducts or any other suitable ducts 38. In FIG. 5, because of the right angle, the duct connection 32 is mostly hidden given the particular perspective view shown in this figure. The aerodynamic characteristics of the side-view cross section 53, which are still funnel-shaped narrowing from the duct 32 toward the opening 1, allow excellent air flow with little air noise levels compared to prior art supply outlets/registers and fenestrative components. These too may be insulated with closed cell foam or equivalent 39 to aid in noise reduction, minimize heat loss and the potential for condensation during cooling seasons.

In fact, the single-duct orthogonal-flow register 5 is identical in all respects to the single-duct straight-flow register 3 including its preferred width 15 and length 34 of the opening 1 being ⅝" and 13.5" respectively and its containing a single duct connection 32, and for the same reasons, with one exception: The latter 5 has a 90 degree orthogonal cross section which redirects the airflow by 90 degrees while the former 3 has a straight cross section which does not redirect the air at all. The choice of 3 versus 5 in a particular situating depends upon the needs required by the framing situation behind the wall, ceiling or floor in which installation is to occur, and the running direction of the ductwork.

Figure 6:
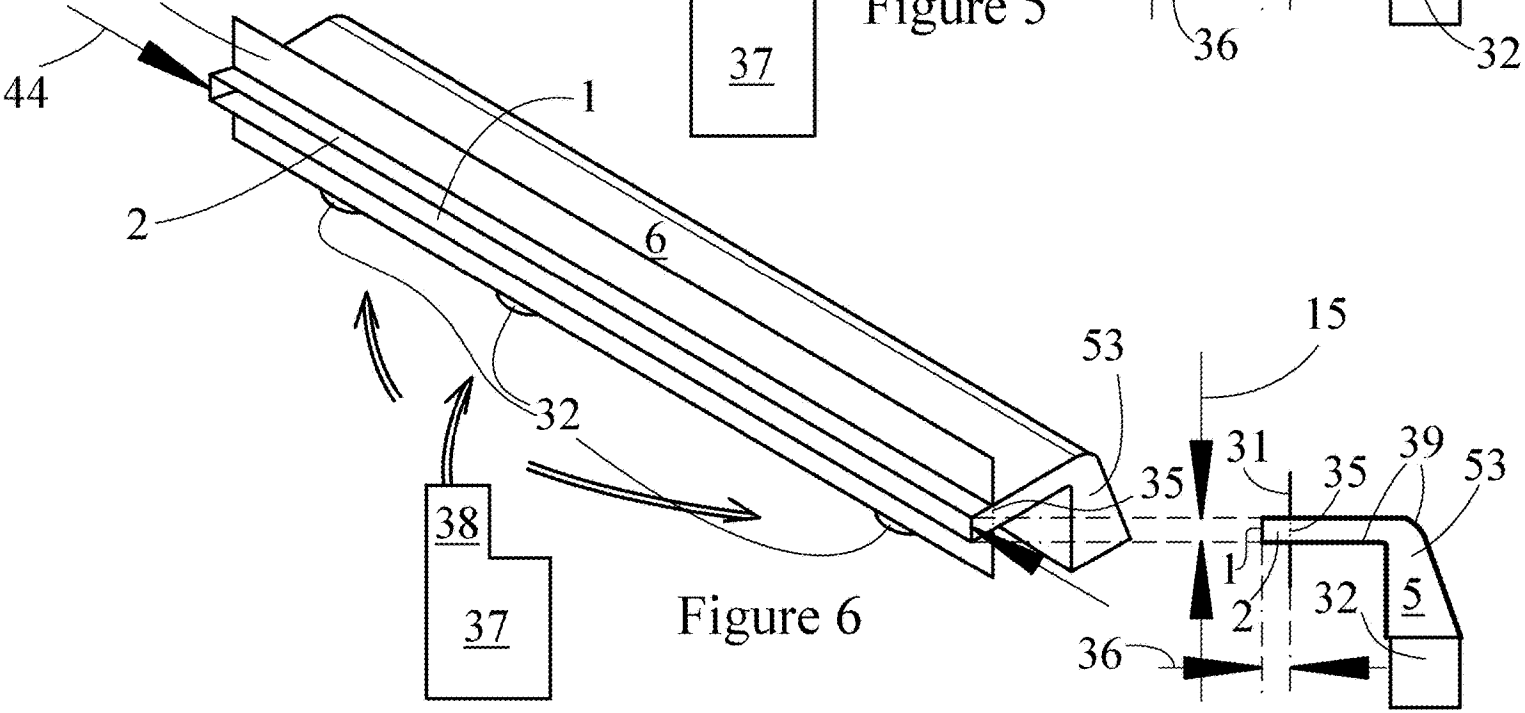
FIG. 6 illustrates a front-right-top perspective view, projected with a side plan view, of a multiple-duct orthogonal-flow register used as one of the active airflow components in accordance with the invention.

In the same way that the register 5 of FIG. 5 is identical to the register 3 of FIG. 3 but for 5 having a 90-degree bend and 3 being straight, so too the multiple-duct orthogonal-flow register 6 of FIG. 6 is identical to the multiple-duct straight-flow register 4 of FIG. 4 but for register 6 having a 90-degree bend and 4 being straight. All other parameters and considerations and reasons for various elements and circumstances of their use remain exactly the same. The only other difference, which is for illustration only, is that whereas the three duct connections 32 in FIG. 4 were illustrated to be centered and equally spaced along the length of 4, the three duct connections 32 in FIG. 6 are illustrated to be unequally spaced, in this illustration, with the middle duct not centered. This is to make the point that it may be desirable to manufacture registers with different positions for duct connection 32 to account for variations in framing and/or ductwork which are expected to be encountered when an indoor space is being constructed, and that this sort of variation falls within the scope of this disclosure and its associated claims. Thus, for example, the FIG. 4 and FIG. 6 duct 32 layouts may be interchanged, and all of this can be varied as required.

Figure 7:
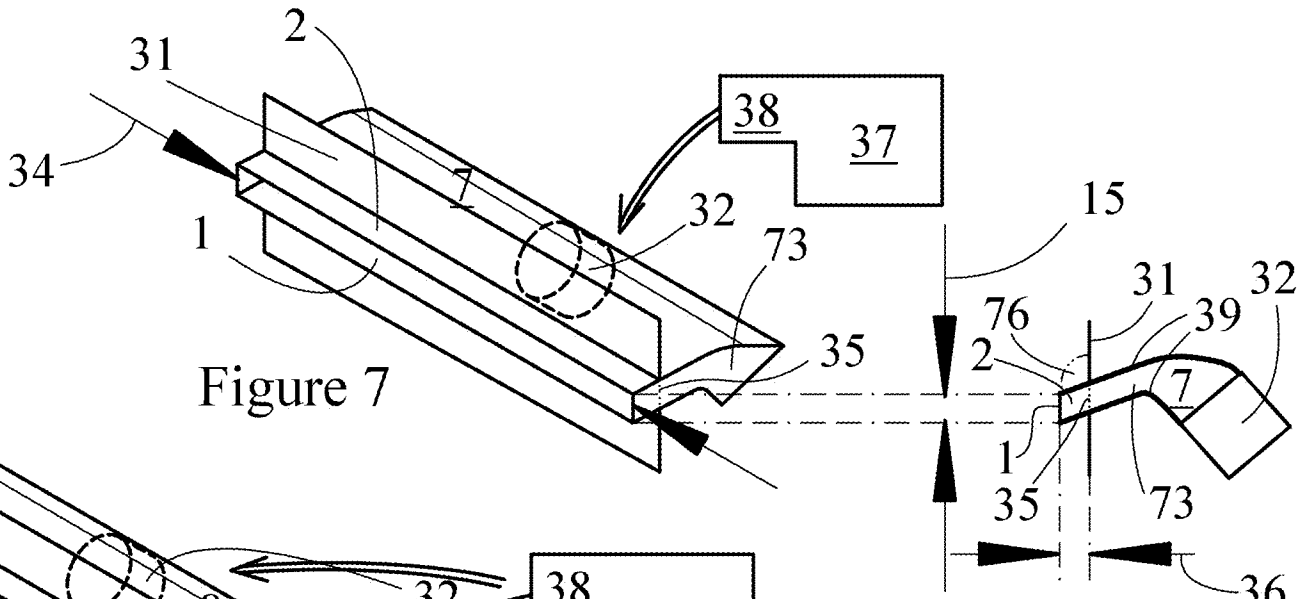
FIG. 7 illustrates a front-right-top perspective view, projected with a side plan view, of a single-duct interior-redirection flow register used as one of the active airflow components in accordance with the invention.

The previously-illustrated active registers all comprise an angle between their active fenestration projection 2 and their active register mounting flange 31 which is substantially equal to 90 degrees. FIG. 7 now illustrates a single-duct interior-redirection flow register 7 that redirects the path of the conditioned air flowing from the duct to interior environment by a redirection angle 76 that is preferably, but without limitation, at least 10 degrees, and preferably 20 degrees, from a right angle relative to the plane of the active register mounting flange 31, which is illustrated by the 110-degree angle 76 in FIG. 7. In other words, the register illustrated in FIG. 7 has angle 76 between its active fenestration projection 2 and its active register mounting flange 31 which differs from 90 degrees by at least 10 degrees, and preferably by 20 degrees. Once again, this flange 31 is set back with the same active register recess distance 36 determined as reviewed previously. But because of the angling 76, it is important to note that the setback is defined normal to the flange, because the determining factor is still the thickness of the indoor space boundary material which the fenestration projection 2 must penetrate.

This single-duct interior-redirection flow register 7 is configured and expected to be installed most often on a ceiling, such as in FIG. 2, or on a floor. Specifically, as can be seen in FIG. 2, if air was to be projected directly downwards at a 90-degree angle relative to the plane of the ceiling, that air would enter the interior space all along the vertical side walls and windows/glass surfaces. The purpose of single-duct interior-redirection flow register 7 is to redirect the air so that it flows more toward the center of the room, by the 20-degree preferred angle. It will be appreciated that for walls in contrast to ceilings, this is generally unnecessary, because air coming into a room normal to a wall will naturally move to the middle and then throughout the room.

As with the registers 3 and 5, this register 7 it is designed to be installed perpendicularly to standard framing within a standard 16" on center framing bay or parallel to existing framing members at the designer's election. It contains the same active register mounting flange 31 that allows mounting of this component solidly to either the face of supportive framing or the rear of the sheet rock interior surface, but again, for this register, the flange 31 is no longer orthogonal to the airflow direction but rather has a preferred, non-limiting 20-degree angle. And it contains a similar fenestration projection 2 culminating in the opening 1, but here, projecting forward at this same 20-degree angle. The duct connections 32 which are hidden in the perspective view of FIG. 7 and so are shown in hidden lines, as with all earlier registers, is designed to connect standard 2" or 2.5" SDHV (sound-attenuating) duct or other suitable ductwork 38. The side cross section which once again funnels air toward the fenestration 1 enables excellent air flow with little air noise levels compared to common currently available supply outlets/registers and fenestrative components. This register may likewise be insulated with closed cell foam or equivalent 39 to aid in noise reduction, and minimize heat loss and the potential for condensation during cooling seasons.

This airflow opening 1 of single-duct interior-redirection flow register 7 has the same preferred ⅝" width 15 as all the other prior registers, and the same preferred 13.5" length 34 as the single-duct straight-flow register 3 and the single-duct orthogonal-flow register 5. Indeed, except for the angle with the active register mounting flange 31 and the different side view cross section 73, this register 7 is identical to the registers 3 and 5.

Figure 8:
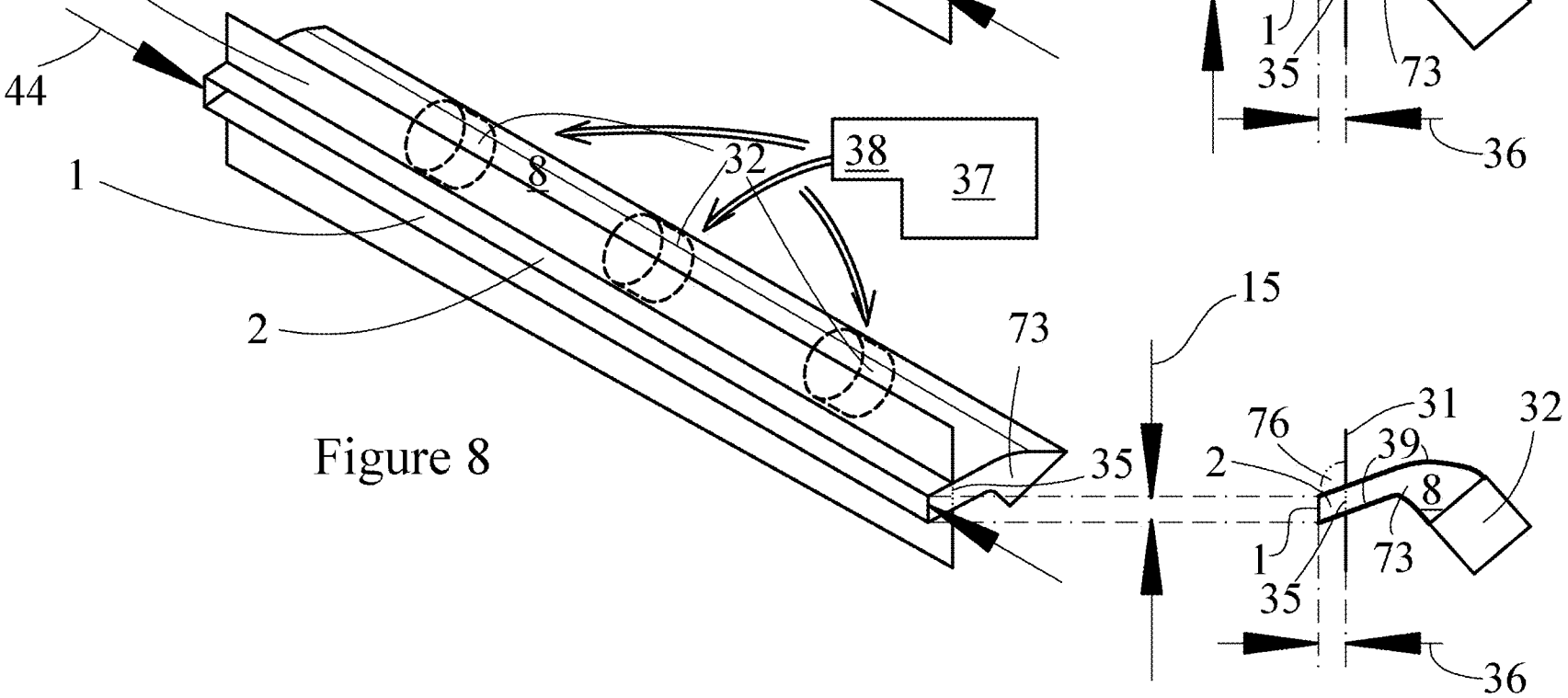
FIG. 8 illustrates a front-right-top perspective view, projected with a side plan view, of a multiple-duct interior-redirection flow register used as one of the active airflow components in accordance with the invention.

Finally, FIG. 8 illustrates a multiple-duct interior-redirection flow register 8 that causes the path of the conditioned air flowing from the duct to interior environment to be redirected by a redirection angle 76 which, like the same angle 76 in FIG. 7 is preferably, but without limitation, 20 degrees from a right angle relative to the plane of the active register mounting flange 31, again as illustrated by the 110-degree angle 76 in FIG. 8, and with a similarly-determined recess distance 36. Likewise, this contains a fenestration projection 2 culminating in the opening 1, but at 20 degrees. This register 8 has the same preferred ⅝" width 15 as all the other prior registers, and the same preferred 28" length 34 as the multiple-duct straight-flow register 4 and the multiple-duct orthogonal-flow register 6. And here, except for the angle 76 with the active register mounting flange 31 and the different side view cross section 73, this register 8 is identical to the registers 4 and 6. Here, we illustrate three duct connections 32 as equally spaced, and centered. But, as pointed out earlier, the number of multiple ducts can be varied and as illustrated in FIG. 6, their positioning may also be varied. This register 8 can be installed perpendicularly to these framing components in most cases with a simple framing modification.

It is important for clarity to note that the angled airflow redirection in FIGS. 7 and 8 serves a different purpose than the angled airflow redirection in FIGS. 5 and 6. In FIGS. 5 and 6 the 90-degree bend redirects air behind the room surface and is intended to manage varying configurations of ductwork and the physical space restrictions that these may impose. In FIGS. 7 and 8 the important angle is the angle 76 between the mounting flange 31 and the fenestration projection 2, which is intended to cause air to enter inside the room at an angle other than 90 degrees from the surface, and specifically, in a direction determined by at the angle 76. While FIGS. 3 through 7 are exemplary of the considerations of redirecting airflow behind the surface and/or establishing the angle at which airflow enters the indoor space, it will be understood that these FIGS. 3 through 7 are non-limiting, and that manufacturing of these components and their angles may be varied within the scope of this disclosure and its associated claims to comport with the specific anticipated physical constraints and requirements of any particular installation.

So, summarizing FIGS. 3 through 8, there are three different side view cross sections for the various registers, namely: the straight-flow cross section of registers 3 and 4, the orthogonal-flow cross section of registers 5 and 6, and the interior-redirection cross section of registers 7 and 8. Amidst all of these, there are shorter-length 34 (preferred 13.5") registers with a single duct, namely, registers 3, 5 and 7; and longer-length 44 (preferred 28") registers with multiple (preferably three) duct connections 32, namely, registers 4, 6 and 8. The longer multiple-duct registers may be fabricated with the duct connections 32 equally spaced and centered, or the spacing can be staggered and/or not centered. The lengths 34 and 44 given above are preferred because of the dimensions employed in the art for typical framing practices; but this does not preclude manufacturing additional or different lengths within the scope of this disclosure and its associated claims, if warranted by particular circumstances.

All of the cross sections for all of these registers narrow in a funnel-shaped configuration from back to front as illustrated. This both optimizes the aerodynamics and allows the fenestration lines 1 to be thin and attractive. All registers have the same active register mounting flange 31. However, for registers 3, 4, 5 and 6 the flange 31 is orthogonal to the intended airflow direction, while for registers 7 and 8 there is a 20-degree angle off the normal so that air can be directed toward the center of the interior space particularly from a ceiling or floor. This angle is established by the fenestration projections 2 culminating in the openings 1. The recess distance 36 is approximately equal to the thickness of the indoor space boundary material to facilitate flush mounting when these are equal, or a slight projection when the distance 36 is slightly larger than the material thickness.

Finally, and importantly, each and every register has a width 15 for its fenestration line 1 that is identical from one register type to the next. The preferred width 15, which optimizes both appearance and aerodynamics, is ⅝", but other widths 15 from as small as ⅜" to as large as 1.5" are still regarded to be within the scope of this disclosure and its associated claims.

Consequently, each of the active registers 3, 4, 5, 6, 7, 8 comprises: an active fenestration projection 2 comprising a width 15 thereof no smaller than ⅜" and no larger than ⅞", and a length 34 thereof no smaller than 12", culminating in an airflow opening 1 at a forward extremity of the active register; an active register mounting flange 31 recessed rearward of the airflow opening 1 by an active register recess distance 36 approximately equal to a thickness of an indoor space boundary material with which the active register is to be used; and at least one duct connection 32 fabricated to connect with an SDHV duct 38, and configured to pass air from the SDHV heating and cooling system 37 through the airflow opening 1 into the indoor space.

Now we turn to FIGS. 9 and 10 which illustrate passive register-connectors 9 and 10 which do not support air flow but rather serve the function of providing a consistent visual line 1 astride and between the active registers of FIGS. 3 through 8. These are passive, connective, visual detail or decorative modules which not only allow a continuous linear design presentation of the active components which flow air, but also may optionally be configured for separate use as a matching linear design element that supports direct or indirect LED strip lighting for main, accent, or specific dramatic lighting effects.

As with all of the active registers in FIGS. 3 through 8, the passive register-connectors 9 and 10 have a fenestration line 1 comprising the same width 15 as all of the register lines 1, preferably ⅝". But these passive register widths 15 can be made smaller or larger to match the widths 15 of the active registers in the event those are made smaller or larger. Similarly to all of the active registers 3, 4, 5, 6, 7 and 8, the passive register-connectors 9 and 10 have a passive register-connector mounting flange 31 of identical form and purpose, to enable mounting of these register-connectors 9 and 10 solidly to either the face of supportive framing or the rear of the sheet rock interior surface. Once again, the flange 31 has a recess distance 36 determined in the same ways as for all of the active registers. And these passive register-connectors 9 and 10 also contain a fenestration projection 2 culminating in a "dummy" opening 1. But in contrast to all of the active registers in FIGS. 3 through 8, the passive register-connectors 9 and 10 omit duct connections 32 because they do not permit airflow therethrough, but rather are "dummy" or "decorative" components provided simply for maintaining a continuous visual line 1 with the lines 1 of the active registers.

As viewed from the side-view projected on the right of FIG. 9, the fenestration line 1 of the passive register-connector 9 projects out at a normal, orthogonal 90-degree orientation relative to the flange 31, in the same manner as for registers 3, 4, 5 and 6. In contrast, as viewed from the side-view projected on the right of FIG. 10, the fenestration line 1 of the passive register-connector 10 projects out at an angle 76 which is not orthogonal, but rather matches the redirection angle 76 of the registers 7 and 8 which as noted, is preferred to be about 20-degrees off-normal but may be varied. Thus, the orthogonally-angled module 9 is used to continue the line 1 of any of registers 3, 4, 5 and 6, while the non-orthogonally-angled module 10 is used to continue the line 1 of either of registers 7 and 8.

The passive register-connectors 9 and 10 are provided in units with a preferred 36" length designated as 94. But, these may be manufactured in longer lengths to minimize joints and simplify installation. If so, they are cut to fit as needed on site (e.g., with a metal saw) and finished to the surface providing the same visual appearance as the active or air flow supporting registers 3, 4, 5, 6, 7 and 8. They may also be made in shorter lengths to reduce the number of cutting operations.

Because the passive register-connectors 9 and 10 have no depth other than the recess distance 36 and in particular take up no space behind the indoor space boundary material after installation aside from the minimal thickness of the mounting flanges 31, the lengths 94 of these passive register-connectors 9 and 10 are unconstrained by the framing considerations behind the passive register-connectors 9 and 10. These are mounted to the inner surface of unmodified standard farming or to additional mounting blocks as required to suit the designer's presentation. These models may or may not be fabricated with end pieces at the end of their length 94, but in the event they are, there is also a score 35 which is used for breaking off the end pieces if desired, just as in all of FIGS. 3 through 8.

Finally, note that the only difference between passive register-connectors 9 and 10 is that for the side view 9 the fenestration projection 2 projects a right angle with the flange 31 while 10 projects an angle 76 that is off-normal by, preferably, 20 degrees. In either case, the recess distance 36 is determined in the same way as reviewed previously, in relation to thickness of the indoor space boundary material with which the passive register-connectors 9 and 10 are to be used. These will either be equal, or will be approximately equal. In the latter circumstance, the fenestration projection 2 may be made slightly larger so that it slightly protrudes into the room, as a design choice. It is perfectly acceptable to only provide the module 9 and not the module 10, because the angled registers 7 and 8 in most installations will be installed along the perimeter of the ceiling, and the fenestrations 1 will be far enough away from a person in the room, and/or that person will be at a sufficient view angle relative to the line 1, and/or the interiors of the fenestrations will be sufficiently dark, that this angular difference will not be discernible.

In sum, each of the passive register-connectors 9, 10 comprises a passive fenestration projection 2 comprising a width 15 thereof which is equal to the width 15 of the active fenestration projections 2 detailed in FIGS. 3 through 8, culminating in a dummy opening 1 at a forward extremity of the passive register-connector 9, 10; a passive register-connector mounting flange 31 recessed rearward of the dummy opening 1 by a passive register-connector recess distance equal to the active register recess distance; and importantly, they omit any duct connection 32 for connecting with a duct.

Figure 11C:
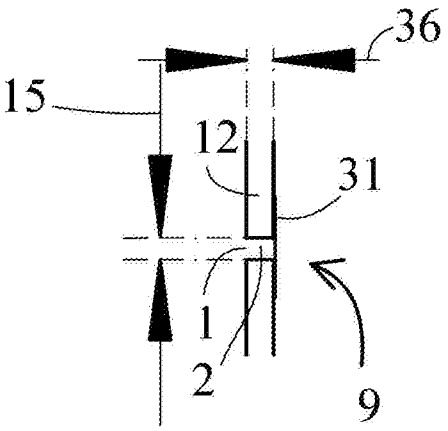
FIG. 11C illustrates a side cross sectional view of a wall installation of the passive register-connector module of FIG. 9.
Figure 11B:
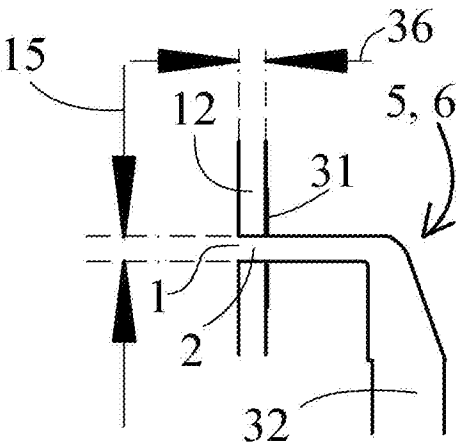
FIG. 11B illustrates a side cross sectional view of a wall installation of the active registers of FIGS. 5 and 6.
Figure 11A:
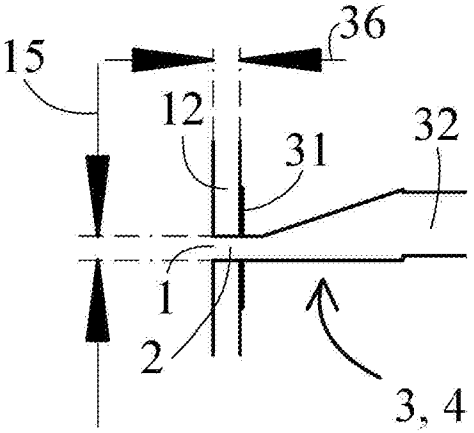
FIG. 11A illustrates a side cross sectional view of a wall installation of the active registers of FIGS. 3 and 4.
Figure 12B:
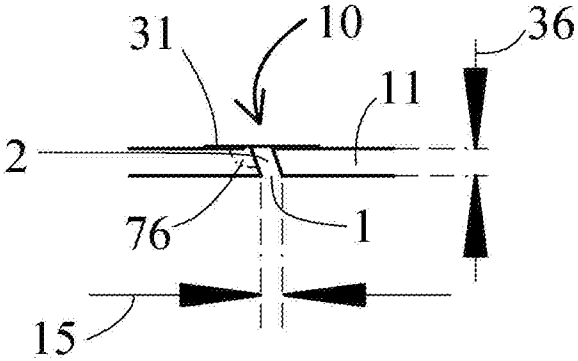
FIG. 12B illustrates a side cross sectional view of a ceiling installation of the passive register-connector of FIG. 10.
Figure 12A:
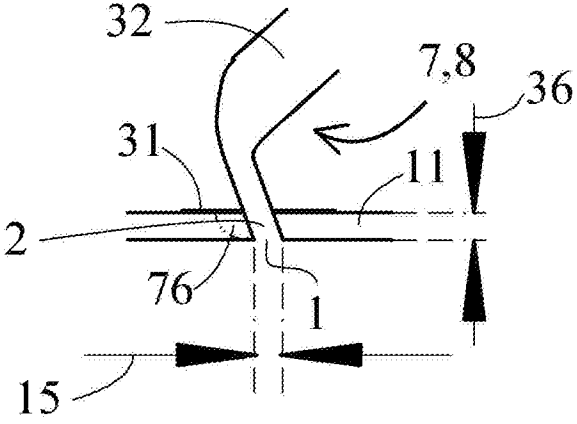
FIG. 12A illustrates a side cross sectional view of a ceiling installation of the active registers of FIGS. 7 and 8.

Let us turn now to FIGS. 11 and 12 which contain side cross sectional illustrations of how the foregoing registers are installed onto, respectively, the walls and ceilings of interior spaces. Specifically, FIG. 11A shows the wall installation of active registers 3 and 4; FIG. 11B shows the wall installation of active registers 5 and 6; FIG. 11C shows the wall installation of passive register-connectors 9; FIG. 12A shows the ceiling installation of active registers 7 and 8; and FIG. 12B shows the ceiling installation of passive register-connectors 10. As earlier noted, floor installation is carried out identically in form to celling installation, so that FIGS. 12A and 12B rotated by 180 degrees also illustrate floor installation.

Starting with FIG. 11A, we see that the active register—whether it be the single-duct 3 or the multiple-duct 4—is mounted behind the indoor space boundary material comprising the wall 12. From the view of FIG. 11A this mount is to the right of the wall 12. The wall 12 will of course comprise sheetrock or wallboard or an equivalent construction suitable for forming the walls of an interior space. Importantly, the active register mounting flange 31 is mounted and secured to the back of the wall 12 and/or to framing behind the wall, and the wallboard material is cut such that the fenestration projection 2 passes through the wall 12 and the opening 1 is fixed to be either flush with or slightly protruding from (designer choice) the interior visible surface of the wall 12. This, as well as the remaining FIGS. 11 and 12, explicitly show how and why recess distances 36 are all sized to exactly or approximately (flush or protrude) match the thickness of the sheetrock, wallboard, floorboard etc. used or which may be used in the art. Thus, from inside the room, cf. FIG. 1, the wall appears to have an elongated line 1 with a preferred width 15 that is ⅝", and no other parts of any active register or any passive register-connectors are visible from inside the indoor space. Therefore, with the duct connection(s) 32 also connected to SDHV ducting 38, when the SDHV system 37 is turned on, air will flow into the room through the opening line 1 wherever the active registers are installed.

FIG. 11B shows the exact same mounting as FIG. 11A, other than the right angle in the orthogonal flow registers 5 (single duct) and 6 (multiple duct). It will be appreciated by comparing FIGS. 11A and 11B, that the selection of a straight-flow register 3 or 4 versus an orthogonal-flow register 5 or 6 to install in any given situation will be dependent on the framing and ducting constraints behind the wall, which are not visible inside the room. If there is sufficient clearance behind the wall 12, then a straight-flow register 3 or 4 may be used. If there is not sufficient clearance, and the ducts can only be run vertically behind the wall 12, then the orthogonal-flow register 5 or 6 is used.

FIG. 11C shows the orthogonally-angled passive register-connector 9 similarly mounted behind the wall 12. As in FIGS. 11A and 11B, the passive register-connector mounting flange 31 is secured to the back of the wall 12 and/or framing, and the wall 12 is cut and the module 9 is placed, such that the fenestration projection 2 passes through the wall 12 and the opening 1 is fixed to be flush with or slightly protruding from the interior visible surface of the wall 12. The only difference is that 9 is a "dummy" or "decorative" component with no airflow. Because it has no duct connections 32, its behind-the-wall placement is far-less constrained. Importantly, the line 1 provided by module 9 has the same width 15 (preferably ⅝") as the lines 1 of the active registers 3, 4, 5 and 6, so that when placed in series next to one of these registers, the visual appearance from this series is that of a single line as illustrated in FIG. 1, especially when the various ends are removed via the score lines 35.

FIGS. 12A and 12B are similar to FIGS. 11A, 11B and 11C, except that FIG. 12 illustrate ceiling rather than wall installations. For FIG. 12A, as noted, the interior-redirection flow registers 7 (shorter) and 8 (longer) project air at an approximate 20-degree angle, so that this air can enter the room proximate the periphery of the ceiling 11 (indoor space boundary material) yet move toward the center of the room for uniform distribution. These components are likewise mounted behind the ceiling 11 via active register mounting flanges 31 with cuts in the ceiling 11 placed such that the fenestration projections 2 pass through the ceiling 11 and the opening 1 is fixed to be flush or slightly protruding (again, design choice) with the interior visible surface of the ceiling 11. The "above the ceiling" mounts and considerations are similar to those "behind the wall" in connection with FIG. 11.

For FIG. 12B, the passive register-connector 10 is similarly mounted behind the ceiling 11. As in FIG. 12A the passive register-connector mounting flange 31 is secured to the back of the ceiling 11 and the ceiling 11 is cut and the module 10 is placed such that the fenestration projection 2 passes through the ceiling 11 and the opening 1 is fixed to be flush with or slightly protruding from the interior visible surface of the ceiling 11. Once again, the only difference is that 10 is a "dummy" or "decorative" component with no airflow, whereas 7 and 8 are configured for airflow. Here too, when a module 10 is placed in series with registers 7 or 8, the visual appearance from this series is that of a single line as illustrated in FIG. 2.

The elongated length 34, 44 and narrow width 15 configuration of the active components of the system, which deliver the supply of conditioned air to the interior environment, reduce the presence of internal elements that would cause turbulence and reduced air flow velocity at the outer edges of the air flow which would then be impacted by the faster-moving central portion of the air flow creating air flow noise. The combination of removing turbulence-creating "edges" within the components using the scoring 35 and the fabrication of an exceptionally smooth interior finish inside the fenestration projections 2 results in less turbulence and noise arising from surface friction between the registers and the flowing air.

Figure 13:
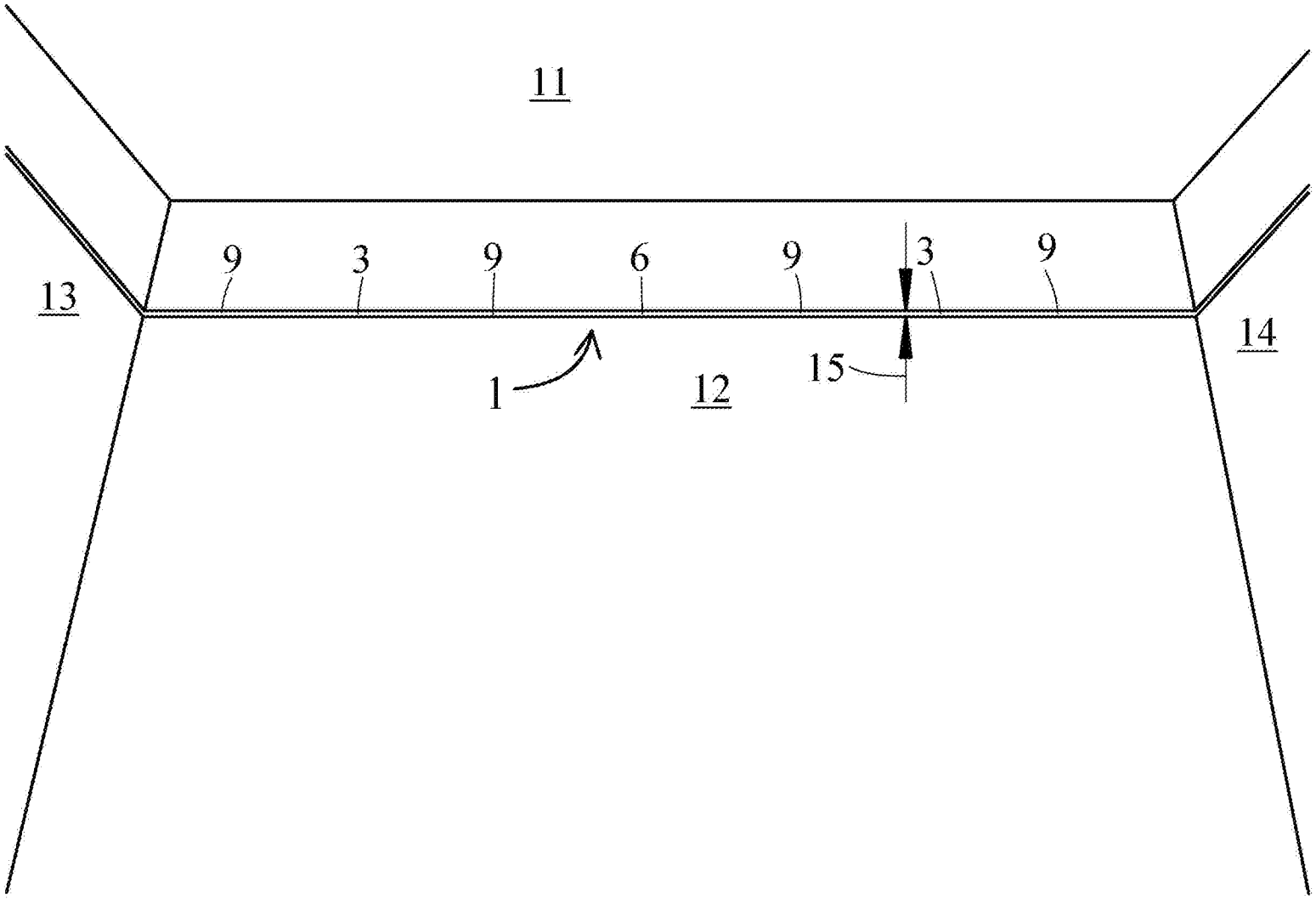
FIG. 13 reproduces FIG. 1, but further illustrates an exemplary, non-limiting hidden placement of the active registers and passive register-connectors behind the wall.

To illustrate this, FIG. 13 is simply FIG. 1, but with additional reference numerals to illustrate—for example not limitation—the use of the foregoing various wall-mount modules to create the visual line 1 of FIG. 1. So as illustrated in FIG. 13, air flows into the room at the top center through a (longer) register type 6, and closer to the top sides through a pair of (shorter) type 3 registers. Further, there are four passive register-connectors 9 situated in series with these three active registers. Two of these are between register 6 and the two registers 3. Two of these are on the outsides of the registers 3, running all the way over to the sides of the wall 12. Although there a total of seven modules are installed "behind the wall" in this illustration, from inside the room all that is visually seen is a continuous line 1 of constant width 15, particularly with score lines 35 having been cut. Unless a person inside the room climbs up on a chair or ladder and uses a flashlight to peek closely inside of the line 1, there is no way to visually discern where one module ends and the next one begins. And this is the entire point: the utilitarian need to deliver heated or cooled air into the room is hidden from visual perception, because all that is seen in a single thin line 1 that may then be incorporated and merged with the design elements of the room. Functionality is hidden, masked in the design of the overall fenestration line 1, and blended with the architectural design of the room.

Figure 14:
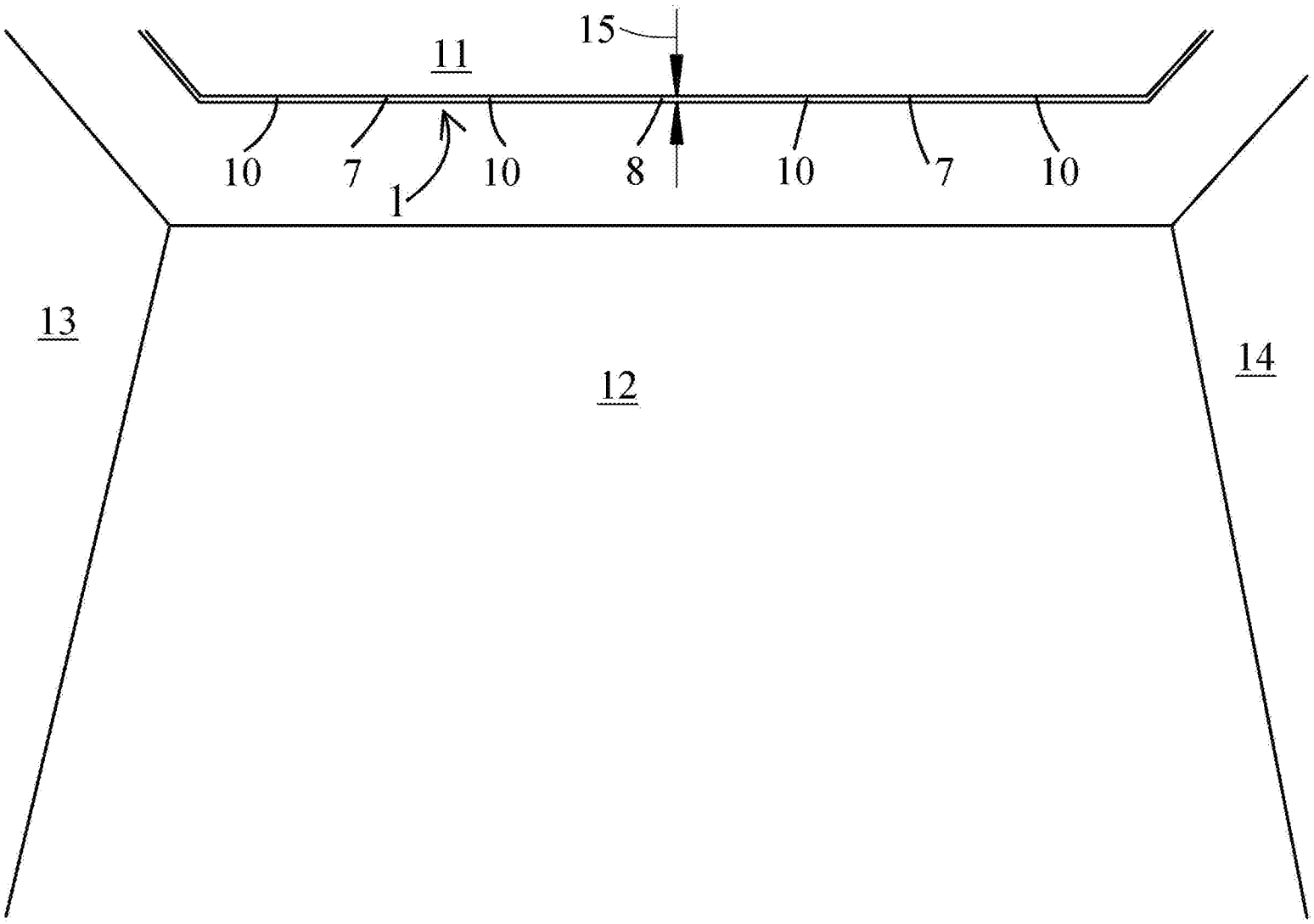
FIG. 14 reproduces FIG. 2, but further illustrates an exemplary, non-limiting hidden placement of the active registers and passive register-connectors above the ceiling.

Likewise, FIG. 14 is simply FIG. 2, but with additional reference numerals to illustrate—for example not limitation—the use of the foregoing various ceiling-mount components to create the visual line 1 of FIG. 2. So as illustrated in FIG. 14, air flows into the room at the center of the ceiling edge through a (longer) register type 8, and closer to the sides through a pair of (shorter) type 7 registers. Further, there are four passive register-connectors 10 situated in series with these three active registers. Two of these are between register 8 and the two registers 7. Two of these are on the outsides of the registers 7, as illustrated. Although there is a total of seven components installed "above the ceiling" in this illustration, from inside the room all that is visually seen is a continuous line 1 of constant width 15. Again, unless a person inside the room climbs up on a chair or ladder a uses a flashlight to peek closely inside of the line 1, there is no way to visually discern where one component ends and the next one begins. And again, this is the entire point: the utilitarian need to deliver heated or cooled air into the room is hidden from visual perception, because all that is seen in a single thin line 1 which may then be incorporated and merged with the design elements of the room. Functionality is hidden, masked in the design of the overall fenestration line 1, and the line 1 is then blended into the architectural design.

Although the foregoing description of the active registers and passive register-connectors in FIGS. 3 through 10 and their installation described in FIGS. 11 through 14 shows eight module types 3, 4, 5, 6, 7, 8, 9 and 10 used for walls and ceilings, it is to be understood that the above descriptions are preferred, not limiting. These modular components may be fabricated in additional lengths and/or with additional cross-sectional angle variants as required to accommodate virtually any type of construction constraints and requirements. Angles are used for two purposes: to redirect airflow behind the walls and ceilings as required by the hidden framing and ductwork, and to determine the angles at which air flows into the room through the fenestrations 1.

Figure 17:
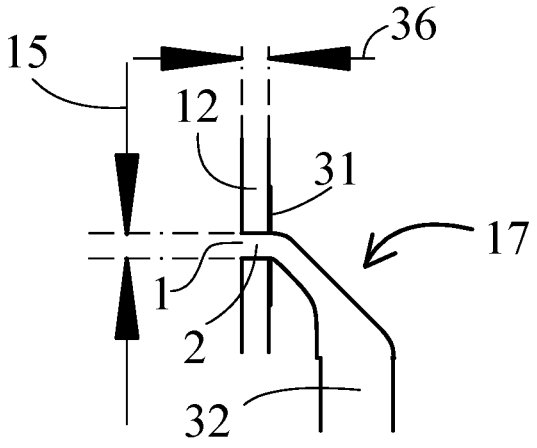
FIG. 17 illustrates a side cross sectional view of a wall installation of a 45 degree-flow register used as one of the active airflow components in accordance with the invention.

For example, FIG. 17 illustrates the cross section of yet another invention embodiment comprising an active-flow register 17 with a 45-degree cross section, installed behind a wall 12 in the same way as was shown in FIG. 11 for registers with different angular profiles, and with permitted length 34, 44, 94 variations earlier illustrated in FIG. 3 through 10. FIG. 17 exemplifies a specific embodiment 17 having a 45-degree profile, which as will be seen redirect the airflow from the connection 32 by a total of 90 degrees but in two successive 45 degree turns. But it also exemplifies the general principle that the cross-sectional profiles, the curvatures and airflow redirections provided by these curvatures, and the lengths 34, 44, 94 of the invention components can be varied in any way that makes sense given the spatial constraints which may be imposed by the indoor space and the behind-the-wall or ceiling spaces into which the invention is to be installed, the desire to minimize noise, and any other spatial, functional or aesthetic objectives.

Furthermore, while it has been disclosed that certain of these modules (3, 4, 5, 6 and 9) are preferred for wall installations while others (7, 8 and 10) are preferred for ceiling (or, inverted, floor) installations, there foregoing disclosures are not limiting. Thus, there is nothing that would prevent the use of the ceiling-preferred components on a wall or vice versa, in the event such use is warranted in any given situation, and such variations from what is preferred remains within the scope of this disclosure and its associated claims.

Furthermore, while best practice would utilize the angled passive register-connector 10 in series with the angled active registers 7 or 8, (as well as the orthogonal passive register-connector 9 with any of 3, 4, 5 and 6 which direct air orthogonally from behind the wall 12 surface) it is possible within the scope of this disclosure and the associated claims to use the orthogonal passive register-connector 9 in lieu of 10, or vice versa. This is because although angle of recess into the ceiling 11 of the fenestration 1 would change between an angled active register 7 or 8 and the orthogonal passive register-connector 9, it would require very close visual inspection of the ceiling 11 fenestration 1 in order to detect this. Likewise, for the wall-intended components. But again, best practice, albeit not required, would maintain a consistent room-entry angle for all adjacent components whether active or passive.

It has been noted that the mounting flanges 31, whether part of an active register or a passive register-connector, are preferably perforated. FIG. 15, which applies to all of the components shown in FIGS. 3 through 6 and 9, and FIG. 16 which applies to all of the components shown in FIGS. 7, 8 and 10, contain frontal views projected with a cross-sectional view to illustrate this in more detail. Specifically, in the frontal views we see a plurality of perforations 150 distributed over the surface of the mounting flange 31, both above and below the fenestration line 1. In FIGS. 11 and 12 it was shown how in all cases, the mounting flange 31 is mounted and secured behind the wall or ceiling (or floor), and specifically, behind the sheetrock or wallboard (or flooring material) or equivalent that is used to construct the finished interior space (collectively, indoor space boundary material). So, it will be appreciated that the perforations 150 provide the means to affix the mounting flange 31 behind the wall or floor or ceiling using carpenter screws or nails, glues, or any other equivalent means for a securing a permanent attachment in accordance with practices in the construction arts.

It has also been disclosed that each of the active registers 3, 4, 5, 6, 7, 8 and passive register connectors 9, 10 comprises physical ends (unnumbered) at the length 34, 44, 94 extremities of their fenestration projections 2, which ends which may be broken off using the scoring lines 35. As discussed, these physical ends may be kept intact at the outer extremities of a series of fenestration projections 2 but removed at all intermediate locations to provide a continuous unbroken visual line 1 following installation. In an alternative preferred embodiment, some or all of the fenestration projections 2 may be fabricated ab initio without any such ends, i.e., omitting any physical ends of their lengths 34, 44, 94, which results in a configuration equivalent to having broken off all the physical ends at the score lines 35.

The knowledge possessed by someone of ordinary skill in the art at the time of this disclosure, including but not limited to the prior art disclosed with this application, is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. An active register for efficiently passing air motivated by a small duct high velocity (SDHV) heating and cooling system into an indoor space while integrating heating and cooling fenestrations with architectural appearances, comprising:

an active fenestration projection comprising a width thereof no smaller than ⅜" and no larger than ⅞", culminating in an airflow opening at a forward extremity of said active register;

an active register mounting flange recessed rearward of said airflow opening by an active register recess distance approximately equal to a thickness of an indoor space boundary material into which said active register is to be installed;

more than one duct connection fabricated to connect with an SDHV duct, and configured to pass air from the SDHV heating and cooling system through said airflow opening into the indoor space; and omitting any trim plate with a neck and fastener apertures of said plate for fastening through a wallboard slot to a separate mounting assembly of said active register to hold said mounting assembly flush against the interior finish.

2. The system of claim 1, active and fenestration projection comprising a width thereof substantially equal to ⅝".

3. The system of claim 1, said active register comprising a side cross section configured to flow air straight from its said more than one duct connection through its said airflow opening without redirecting said airflow.

4. The system of claim 1, said active register comprising a side cross section configured to redirect an airflow direction from its said more than one duct connection through its said airflow opening.

5. The system of claim 1, said active register comprising an angle between its said active fenestration projection and its said active register mounting flange which is substantially equal to 90 degrees.

6. The system of claim 1, said active register comprising an angle between its said active fenestration projection and its said active register mounting flange which differs from 90 degrees by at least 10 degrees.

7. The system of claim 1, at least one of said active fenestration projections omitting physical ends at the length extremities of their fenestration projections, said omitting said physical ends arising from one of:

the breaking a score line to remove said physical ends; and the ab initio fabrication of said fenestration projection without said physical ends.

8. The active register of claim 1, further comprising a funneled side cross section, with a wide end of said funnel proximate said duct connections, narrowing toward a narrow end of said funnel proximate said active fenestration projection.

9. The active register of claim 1, further comprising closed cell foam or equivalent for insulating said active register from heat loss when said active register is used for heating, minimizing condensation when said active register is used for cooling, and minimizing noise during both heating and cooling.

10. A passive register-connector apparatus for integrating with architectural appearances, heating and cooling fenestrations of an active register flowing air motivated by a small duct high velocity (SDHV) heating and cooling system into an indoor space, said passive register-connector comprising:

a passive fenestration projection comprising a width thereof which is equal to a width of an active fenestration projection of the active register, culminating in a dummy opening at a forward extremity of said passive register-connector;

a passive register-connector mounting flange recessed rearward of said dummy opening by a passive register-connector recess distance equal to an active register recess distance of the active register; and omitting any duct connection for connecting with an airflow duct and omitting any trim plate with a neck and fastener apertures of said plate for fastening through a wallboard slot to a separate mounting assembly of said passive register to hold said mounting assembly flush against the interior finish.

11. The apparatus of claim 10, said passive fenestration projection comprising a width thereof no smaller than ⅜" and no larger than ⅞".

12. The apparatus of claim 11, said passive fenestration projection comprising a width thereof substantially equal to ⅝".

13. The apparatus of claim 10, said passive register-connector recess distance substantially equal to a thickness of an indoor space boundary material into which said passive register-connector is to be installed.

14. A method for integrating heating and cooling fenestrations with architectural appearances, used in connection with a linear supply outlet system for efficiently passing air motivated by a small duct high velocity (SDHV) heating and cooling system into an indoor space, said method comprising: providing more than one active register, each said active register comprising: an active fenestration projection comprising a width thereof no smaller than ⅜" and no larger than ⅞", culminating in an airflow opening at a forward extremity of said active register; an active register mounting flange recessed rearward of said airflow opening by an active register recess distance approximately equal to a thickness of an indoor space boundary material; and more than one duct connection fabricated to connect with an SDHV duct, and configured to pass air from the SDHV heating and cooling system through said airflow opening into the indoor space; and omitting any trim plate with a neck and fastener apertures of said plate for fastening through a wallboard slot to a separate mounting assembly of said active register to hold said mounting assembly flush against the interior finish; and installing said more than one active register into an indoor space boundary material by mounting said active register mounting flange behind the indoor space boundary material while passing said active fenestration projection through said indoor space boundary material; at least two of said active registers form a continuous visual line with one another; said airflow opening is substantially flush with the interior visible surface of said indoor space boundary material; all other parts of said more than one active register are not visible from inside the indoor space; and the wallboard slot which passes said active fenestration projection through said indoor space boundary material is sized to have no gap between said active fenestration projection and said boundary material.

15. The method of claim 14, said active fenestration projections comprising widths thereof substantially equal to ⅝".

16. The method of claim 14, at least one of said active registers comprising a side cross section configured to flow air straight from its said more than one duct connection through its said airflow opening without redirecting said airflow.

17. The method of claim 14, at least one of said active registers comprising a side cross section configured to redirect an airflow direction from its said more than one duct connection through its said airflow opening.

18. The method of claim 14, at least one of said active registers comprising an angle between its said active fenestration projection and its said active register mounting flange which is substantially equal to 90 degrees.

19. The method of claim 14, at least one of said active registers comprising an angle between its said active fenestration projection and its said active register mounting flange which differs from 90 degrees by at least 10 degrees.

20. The method of claim 14, further comprising omitting physical ends at the length extremities of at least one of said fenestration projections, by one of:

breaking a score line to remove said physical ends; and ab initio fabricating said fenestration projection without said physical ends.

21. The method of claim 14, further comprising, for at least one of said active registers, providing a funneled side cross section thereof, with a wide end of said funnel proximate said duct connections, narrowing toward a narrow end of said funnel proximate said active fenestration projection.

22. The method of claim 14, further comprising insulating said active register from heat loss when said active register is used for heating, minimizing condensation when said active register is used for cooling, and minimizing noise during both heating and cooling, using a closed cell foam or equivalent.

23. A linear supply outlet system for efficiently passing air motivated by a small duct high velocity (SDHV) heating and cooling system into an indoor space while integrating heating and cooling fenestrations with architectural appearances, comprising:

at least one active register, each said active register comprising:

an active fenestration projection comprising a width thereof no smaller than ⅜" and no larger than ⅞", culminating in an airflow opening at a forward extremity of said active register;

an active register mounting flange recessed rearward of said airflow opening by an active register recess distance approximately equal to a thickness of an indoor space boundary material into which said active register is to be installed; and at least one duct connection fabricated to connect with an SDHV duct, and configured to pass air from the SDHV heating and cooling system through said airflow opening into the indoor space; and omitting any trim plate with a neck and fastener apertures of said plate for fastening through a wallboard slot to a separate mounting assembly of said active register to hold said mounting assembly flush against the interior finish; and at least one passive register-connector, each said passive register-connector comprising:

a passive fenestration projection comprising a width thereof which is equal to said width of said active fenestration projection, culminating in a dummy opening at a forward extremity of said passive register-connector;

a passive register-connector mounting flange recessed rearward of said dummy opening by a passive register-connector recess distance equal to said active register recess distance; and omitting any duct connection for connecting with an airflow duct.

24. A method for integrating heating and cooling fenestrations with architectural appearances, used in connection with a linear supply outlet system for efficiently passing air motivated by a small duct high velocity (SDHV) heating and cooling system into an indoor space, said method comprising: providing at least one active register, each said active register comprising: an active fenestration projection comprising a width thereof no smaller than ⅜" and no larger than ⅞", culminating in an airflow opening at a forward extremity of said active register; an active register mounting flange recessed rearward of said airflow opening by an active register recess distance approximately equal to a thickness of an indoor space boundary material; at least one duct connection fabricated to connect with an SDHV duct, and configured to pass air from the SDHV heating and cooling system through said airflow opening into the indoor space; and omitting any trim plate with a neck and fastener apertures of said plate for fastening through a wallboard slot to a separate mounting assembly of said active register to hold said mounting assembly flush against the interior finish; and providing at least one passive register-connector, each said passive register-connector comprising: a passive fenestration projection comprising a width thereof which is equal to said width of said active fenestration projection, culminating in a dummy opening at a forward extremity of said passive register-connector; a passive register-connector mounting flange recessed rearward of said dummy opening by a passive register-connector recess distance equal to said active register recess distance; and omitting any duct connection for connecting with an airflow duct; wherein following said installing in combination with the configuration of said at least one active register and said at least one passive register-connector: installing said at least one active register into an indoor space boundary material by mounting said active register mounting flange behind the indoor space boundary material while passing said active fenestration projection through said indoor space boundary material; and installing said at least one passive register-connector into the indoor space boundary material in series adjacent to one of said active registers by mounting said passive register-connector mounting flange behind the indoor space boundary material while passing said passive fenestration projection through said indoor space boundary material; wherein following said installation: said at least one active register and said at least one passive register-connector form a continuous visual line with one another; said airflow opening and said dummy opening are substantially flush with the interior visible surface of said indoor space boundary material; all other parts of said at least one active register and said at least one passive register-connector are not visible from inside the indoor space; and the wallboard slot which passes said active fenestration projection through said indoor space boundary material is sized to have no gap between said active fenestration projection and said boundary material.

* * * * *